US008652717B2

(12) United States Patent
Shimoyama et al.

(10) Patent No.: US 8,652,717 B2
(45) Date of Patent: Feb. 18, 2014

(54) IMAGE BEARING MEMBER AND IMAGE FORMING METHOD, IMAGE FORMING APPARATUS, AND PROCESS CARTRIDGE USING THE SAME

(75) Inventors: Keisuke Shimoyama, Shizuoka (JP); Hiroshi Ikuno, Kanagawa (JP); Tetsuya Toshine, Shizuoka (JP); Tomoharu Asano, Shizuoka (JP); Yasuhito Kuboshima, Tokyo (JP); Yuuji Tanaka, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/329,525

(22) Filed: Dec. 19, 2011

(65) Prior Publication Data

US 2012/0163860 A1 Jun. 28, 2012

(30) Foreign Application Priority Data

Dec. 27, 2010 (JP) ..... 2010-289463
Mar. 16, 2011 (JP) ..... 2011-057519

(51) Int. Cl.
*G03G 15/04* (2006.01)

(52) U.S. Cl.
USPC ..... 430/66; 430/56; 430/69

(58) Field of Classification Search
USPC ..... 430/56, 66, 69
See application file for complete search history.

(56) References Cited

U.S. PATENT DOCUMENTS 5,656,406 A 8/1997 Ikuno et al.
5,871,876 A 2/1999 Ikuno et al.
5,888,690 A * 3/1999 Yoshinaga et al. ..... 430/132
6,289,190 B1 9/2001 Amamiya et al.
6,432,596 B2 8/2002 Ikuno et al.
6,998,209 B2 2/2006 Ikuno et al.
7,189,487 B2 3/2007 Ikuno et al.
7,629,103 B2 12/2009 Ikuno et al.
7,851,119 B2 12/2010 Toshine et al.
7,858,278 B2 12/2010 Ikuno et al.
7,897,309 B2 3/2011 Tanaka
7,919,220 B2 4/2011 Shimoyama et al.
8,043,773 B2 10/2011 Ikuno et al.
2007/0031746 A1 2/2007 Toshine et al.
2007/0122724 A1* 5/2007 Suzuki et al. ..... 430/58.7
2007/0248901 A1 10/2007 Shimoyama et al.

(Continued)

FOREIGN PATENT DOCUMENTS

EP 0984334 A2 3/2000
EP 2000855 A1 12/2008

(Continued)

OTHER PUBLICATIONS

Mar. 30, 2012 European search report in connection with counterpart European patent application No. 11 19 5423.

*Primary Examiner* — Stewart Fraser
(74) *Attorney, Agent, or Firm* — Cooper & Dunham LLP

(57) ABSTRACT

An image bearing member having an electroconductive substrate, a photosensitive layer overlying the electroconductive layer, and a cross-linked surface layer overlying the photosensitive layer, which contains a cross-linked polymer and a first compound consisting essentially of a nitrogen atom and a phenyl group, biphenyl group, and condensed polycyclic hydrocarbon group, or a second compound consisting essentially of a nitrogen atom and hydrogen atoms, halogen atoms, alkyl groups, alkoxy groups, or aryl groups, substituted or non-substituted alkyl groups, substituted or non-substituted alkoxy groups, substituted or non-substituted aralkyl groups, substituted or non-substituted aryl group, substituted or non-substituted alkylene groups, cyano groups, nitro groups, or —OCO=$CH_2$R16, in which R16 represents a hydrogen atom, a substituted or non-substituted alkyl group, a substituted or non-substituted alkoxy group, or a substituted or non-substituted aryl group.

14 Claims, 4 Drawing Sheets

(56) References Cited

U.S. PATENT DOCUMENTS

| | | | | |
|---|---|---|---|---|
| 2008/0304867 | A1 | 12/2008 | Nagai et al. | |
| 2010/0167192 | A1 * | 7/2010 | Yamada et al. | 430/66 |

FOREIGN PATENT DOCUMENTS

| | | | |
|---|---|---|---|
| EP | 2219080 | A2 | 8/2010 |
| JP | 5-107784 | | 4/1993 |
| JP | 5-216249 | | 8/1993 |
| JP | 7-72636 | | 3/1995 |
| JP | 9-236938 | | 9/1997 |
| JP | 2003-43706 | | 2/2003 |
| JP | 2004-302450 | | 10/2004 |
| JP | 2005-62302 | | 3/2005 |
| JP | 2006-138956 | | 6/2006 |
| JP | 2006-154796 | | 6/2006 |
| JP | 2007-178813 | | 7/2007 |

* cited by examiner

IMAGE BEARING MEMBER AND IMAGE FORMING METHOD, IMAGE FORMING APPARATUS, AND PROCESS CARTRIDGE USING THE SAME

CROSS-REFERENCE TO RELATED APPLICATIONS

This patent application is based on and claims priority pursuant to 35 U.S.C. §119 to Japanese Patent Application Nos. 2010-289463 and 2011-057519, filed on Dec. 27, 2010 and Mar. 16, 2011, respectively in the Japanese Patent Office, the entire disclosure of which is hereby incorporated herein by reference.

FIELD OF THE INVENTION

The present invention relates to an image bearing member and an image forming method, an image forming apparatus, and a process cartridge using the image bearing member.

BACKGROUND OF THE INVENTION

For example, the Carlson method is applied to forming images with electrophotography using such an image bearing member. Image formation employing this method includes electrostatic charging of the image bearing member typically by corona discharge in a dark place, forming a latent electrostatic image such as texts of a manual or a picture on the surface of the charged image bearing member, developing the formed latent electrostatic image with toner into a visible image, and fixing the developed toner image on a substrate (recording medium) such as paper. The image bearing member after toner image transfer is then neutralized to remove the charge, cleared of remaining toner, and readied for the next image formation.

Recently, organic photoconductors (OPCs) have replaced inorganic photoreceptors (photoconductors) in photocopiers, facsimile machines, laser printers, and multi-functional devices thereof in light of the performance advantages that OPCs offer. Specific reasons for this supersession include, for example, (1) good optical characteristics, for example, a wide range of optical absorption wavelengths and large amount of light absorption; (2) electric characteristics, for example, high sensitivity and stable chargeability; (3) a wide range of selectable materials; (4) ease of manufacturing; (5) inexpensive cost; and (6) toxic-free property.

Image bearing members are required to hold surface charges in a dark place, and generate and transport electrostatic charges upon exposure to light. Image bearing members are classified into two main types: A single-layer type in which a single layer has these features, and a feature-separating laminate type having one layer mainly contributing to generating charges and another layer contributing to holding surface charges in a dark place and transporting charges upon exposure.

Currently, image bearing members of the function-separating laminate type have a photosensitive layer formed of a charge-generating layer containing a charge-generating material and a charge transport layer containing a charge transport material are dominant. Among these, many image bearing members of a negative charging type have been proposed, which have a charge-generating layer in which organic pigments are deposited or dispersed in a resin as a charge-generating material and a charge transport layer in which low molecular weight organic compounds are dispersed in a resin as a charge transport material.

In addition, the current trend toward smaller image forming apparatuses has necessarily accelerated size reduction of the photoreceptor (hereinafter also referred to as an image bearing member). At the same time, with increasingly higher operating speeds and a preference for maintenance-free machines, a highly durable image bearing member is sought. Also, with rapid advancement of full colorization and high speed image forming, image forming apparatuses have spread from the general business field to the fields of SOHO and quick printing. In particular, the printing volume in the quick printing field has been extremely increasing and the demand for stability of the image quality has become severe. Therefore, it is necessary that the organic image bearing members have good durability and electrostatic stability. To date, however, such an OPC remains elusive.

As a method of manufacturing an organic image bearing member having good durability, for example, Japanese patent application publication no. 2006-154796 (JP-2006-154796-A) describes a method of providing a cross-linked surface layer having excellent abrasion resistance because of three-dimension cross-linking of a material cured by light or electron beams. Furthermore, to improve abrasion resistance, there are image bearing members in which inorganic particulates and/or organic particulates are dispersed in the cross-linked surface layer. Image bearing members having such a cross-linked surface layer are successful in terms of improvement of the durability but not the electrostatic stability.

Although the reasons why the image bearing members having such a cross-linked surface layer fail to provide improved electrostatic stability are not completely understood, one possibility is that part of the charge transport material contained in the cross-linked surface layer is decomposed affected by the optical energy and the electron beams, with at least part of the charge transport material changing upon application of light and electron beams. Consequently, compounds having different energy levels are present in the cross-linked surface layer.

Such materials present in the cross-linked surface layer cause changes to the image bearing member over time. For example, the charging voltages decreases, the voltage at irradiated portions varies, resolution deteriorates (so-called image blur) due to decrease of surface resistance, etc.

As a result, image quality deteriorates sharply, thereby ending the working life of the image bearing member prematurely.

In particular, unstable voltage at irradiated portions of an image bearing member causes a serious problem for an image forming apparatus for use in the quick printing field, which requires an extremely long working life and high stability of the image bearing member. Unstable voltage at irradiated portions occurring when a image forming operation resumes after completing a previous image forming operation is more problematic than that occurring in the middle of printing for a relatively long time. Hereinafter, the former is referred to as change in the voltage at irradiated portions in one job (or intra-job charge instability) and, the latter, change in the voltage at irradiated portions in one day (or intra-day charge instability).

The change in the voltage at irradiated portions in one day does not create a large problem because the impact thereof tends to be unnoticeable and the voltage can be corrected in the image forming apparatus. On the other hand, when the voltage at irradiated portions greatly changes in one job, the impact thereof stands out. In addition, if the voltage at irradiated portions fluctuates during printing images on several sheets or several tens of sheets, correcting the voltage is difficult, which causes a serious problem In particular, in the quick printing field, printing the same image pattern in quantity in a single job is often demanded. If the voltage at irradiated portions greatly changes in one job, the image density changes, degrading image consistency. This degradation is not conspicuous when printing an image pattern mainly formed of text. However, it is conspicuous when printing an image pattern having little text, and moreover if it is full color, not only the image density but also the color change, which creates an extremely serious problem.

That is, in addition to reducing the fluctuation of the voltage at irradiated portions of an image bearing member on the whole, reducing not only the fluctuation in the voltage at irradiated portions in one day but also in one job for repetitive printing over a long period is required.

To meet such demand, improvement in the electrostatic stability of an image bearing member having a cross-linked surface layer has been attempted in many ways. For example, JP-2006-154796-A mentioned above describes an image bearing member having a surface layer formed by curing a tri- or higher functional radical polymerizable monomer having no charge transport structure and a radical polymerizable monomer having a charge transport structure.

JP-2007-178813-A describes a method of improving the electric characteristics of the cross-linked surface layer by containing at least one chain polymerizable benzidine compound and at least one chain polymerizable triphenyl amine compound in a polymer obtained by polymerizing and/or cross-linking in a cross-linked surface layer (second charge transport layer). However, when the charge transport material is polymerized and cross-linked, these molecules lose freedom of movement, which degrades charge transport performance.

In addition, since the used charge transport material is reactive, it is probable that non-reacted material remains and there may be some impact on the charge transport structure in the cross-linking reaction or polymerization reaction. In such a case, these charge transport materials are easily affected by oxidized gas, which may lead to accumulation of charges, resulting in deterioration of electrostatic stability.

JP-H09-236938-A describes a method of reducing the deterioration of the electric characteristics by preventing the charge transport material from eluting into the cross-linked surface layer by using a charge transport polymer in the charge transport layer provided just below the cross-linked surface layer (surface protecting layer). However, when cross-linking is performed by irradiation with electron beams or light, deterioration of the charge transport material for use in the cross-linked surface layer is not prevented.

JP-2003-043706-A describes a method of preventing deterioration of the performance of an organic image bearing member occurring when curing a UV curable coating paint by mainly using ultraviolet light having a wavelength of 310 nm or less having a high absorption coefficient to irradiate an organic material and cause it to absorb the ultraviolet light at or near the material surface. Although successful to some extent, absorption of the light by the UV curable type charge transport material still occurs upon UV irradiation and degrades the molecules, which degrades electrostatic stability.

JP-2006-138956-A describes a method of improving the electrostatic stability of an image bearing member having a cross-linking type charge transport layer by using a charge transport radical polymerizable monomer and the same charge transport material having a low molecular weight as the cross-linked type charge transport layer in the cross-linked type charge transport layer. However, the charge transport radical polymerizable monomer and the same charge transport material having a low molecular weight also deteriorate upon irradiation with ultraviolet light, which leads to degradation of the electrostatic stability.

JP-2005-062302-A describes a method of forming a charge transport layer having an ideal arrangement of charge transport groups by forming a cured mixture of a first charge transport compound having at least an acryloyloxy group or methacryloyloxy group and a second charge transport compound having a hydroxy group to add and cure the charge transport compound having at least one hydroxy group having a high affinity with the acryloyloxy group or methacryloyloxy group in one molecule. Therefore, the charge transport compound having a hydroxy group is fit in the three dimensional cross-linking network structure. However, since the charge transport compound having a hydroxy group has a high affinity with water vapor, it is inferior in the environment change.

In addition, when charge transport materials having different energy levels are present in the charge transport layer, the electric characteristics deteriorate because the charge transport is inhibited among the materials, which leads to poor electrostatic stability.

As a technology to improve the abrasion resistance of a photosensitive layer, Japanese patent no. H05-216249-A describes providing a charge transport layer formed by curing a monomer having a carbon-carbon double bond, a charge transport material having a carbon-carbon double bond, and binder resins. The binder resins contain a binder resin having a carbon-carbon double bond reactive with the charge transport material described above and a binder resin having no carbon-carbon double bond non-reactive with the charge transport material. This image bearing member has a good combination of abrasion resistance and electrical characteristics. However, when the binder resin non-reactivity is used, the binder resin is incompatible with the cured material produced by reaction between the monomer and the charge transport material, thereby causing phase separation in the cross-linked surface layer. Therefore, portions having a low abrasion resistance are made locally, which may cause scarring of the surface of the image bearing member and fixation of the toner external additive and paper dust.

JP-2004-302450-A describes an image bearing member having good durability and producing quality images for a long period of time by providing a cross-linked layer formed by curing a tri- or higher functional radical polymerizable monomer having no charge transport structure and a monofunctional radical polymerizable compound having a triaryl amine structure. The cross-linked layer has an elastic displacement ratio $\tau e$ of 35% or higher with a standard deviation of 2% or lower. However, upon further investigation the present inventors have found that compounds having a triaryl amine structure exhibit changes in a portion of the charge transport structure in the cross-linked surface layer due to chemical reactions such as oxidation and dissolution upon irradiation with light, resulting in an uneven charge transport structure, an increase in residual charge, reduced chargeability, image blur over extended use, etc.

JP-H07-072636-A describes a method of preventing phase separation due to crystallization of the charge transport material by using triphenylamine having at least two phenyl groups having three alkyl groups. However, this is not dispersed in the cross-linked resin. In addition, this method does not take into consideration balance with development of a three-dimensional network.

SUMMARY OF THE INVENTION

In view of the foregoing, the present invention provides an improved an image bearing member having an electroconductive substrate, a photosensitive layer overlying the electroconductive layer, and a cross-linked surface layer overlying the photosensitive layer, comprising a cross-linked polymer and a first compound represented by Chemical structure I or a second compound represented by Chemical structure II, Chemical structure I

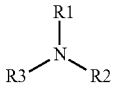

R1 to R3 independently represent phenyl groups, biphenly groups, and condensed polycyclic hydrocarbon groups, all of which may have a substitution group selected from the group consisting of an alkyl group having one to four carbon atoms, an alkoxy group having one to four carbon atoms, and a halogen atom, and at least one of R1 to R3 is the condensed polycyclic hydrocarbon group; and Chemical structure II

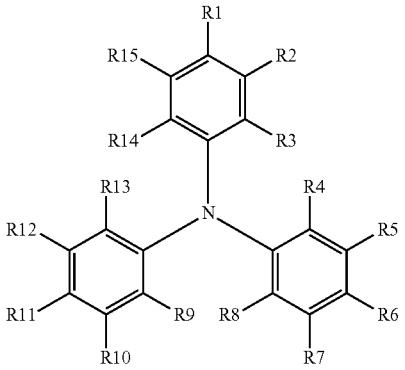

R3, R4, R8, R9, R13, and R14 independently represent hydrogen atoms, halogen atoms, alkyl groups, alkoxy groups, or aryl groups excluding a case in which all are hydrogen atoms, and R1, R2, R5, R6, R7, R10, R11, R12, and R15 independently represent hydrogen atoms, halogen atoms, substituted or non-substituted alkyl groups, substituted or non-substituted alkoxy groups, substituted or non-substituted aralkyl groups, substituted or non-substituted aryl groups, substituted or non-substituted alkylene groups, cyano groups, nitro groups, or —O—CO—C═$CH_2$R16, in which R16 represents a hydrogen atom, a substituted or non-substituted alkyl group, a substituted or non-substituted alkoxy group, or a substituted or non-substituted aryl group.

It is preferred that, in the image bearing member mentioned above, the cross-linked surface layer is a cross-linked film cured by irradiation with light.

It is still further preferred that, in the image bearing member mentioned above, the cross-linked polymer is formed by curing a radical polymerizable monomer having at least three functional groups and a photopolymerizable initiator by irradiation with light or electron beams.

It is still further preferred that, in the image bearing member mentioned above, the cross-linked surface layer contains inorganic particulates.

It is still further preferred that, in the image bearing member mentioned above, the cross-linked surface layer has the second compound in an amount of 10% by weight to 70% by weight.

It is still further preferred that, in the image bearing member mentioned above, the second compound has no absorption at a wavelength of 350 nm or longer.

It is still further preferred that, in the image bearing member mentioned above, the second compound and the cross-linked polymer are chemically bonded.

As another aspect of the present invention, an image forming method is provided which includes the steps of: charging the image bearing member mentioned above, irradiating a surface of the image bearing member to form a latent electrostatic image thereon, developing the latent electrostatic image with a developing agent comprising toner to obtain a visible image, and transferring the visible image to a transfer medium.

As another aspect of the present invention, an image forming apparatus is provided which includes the image bearing member, a charging device to charge the image bearing member, an irradiation device to irradiate the surface of the image bearing member to form a latent electrostatic image thereon, a development device to develop the latent electrostatic image with a developing agent containing toner to obtain a visible image, and a transfer device to transfer the visible image to a transfer medium.

As another aspect of the present invention, a process cartridge detachably attachable to an image forming apparatus n image forming apparatus is provided which includes the image bearing member mentioned above and one or more devices selected from the group consisting of a charging device to charge the image bearing member, a development device to develop a latent electrostatic image on the surface of the image bearing member with a developing agent comprising toner to obtain a visible image, a transfer device to transfer the visible image to a transfer medium, a cleaning device to remove residual toner remaining on the surface of the image bearing member, and a neutralizing device to remove the charge from the image bearing member.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

When measuring a target color patch affected by color patches therearound, which includes the color patches having a color and brightness greatly different from those of the target color patch, the measuring values of the target color patch significantly vary. Therefore, if color patches having a color close to that of a target color patch are arranged therearound, the error of the measuring results can be reduced.

The present disclosure is described below in detail with reference to accompanying drawings.

Image Bearing Member

Figure 1:
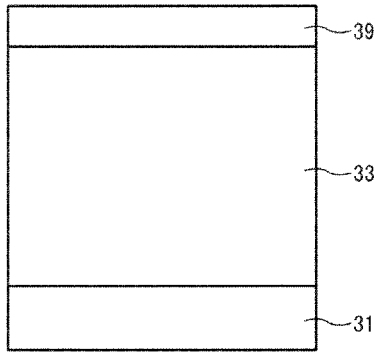
FIG. 1 is a cross section illustrating a structure example of the image bearing member of the present disclosure.

FIG. 1 is a cross section illustrating a structure example of the image bearing member of the present disclosure in which a photosensitive layer 33 mainly made of a charge generating material and a charge transport material is provided on an electroconductive substrate 31 and a cross-linked surface layer 39 is provided on the surface of the photosensitive layer 33.

Figure 2:
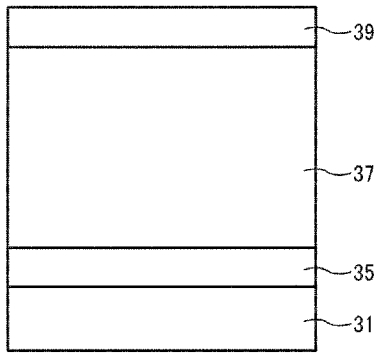
FIG. 2 is a cross section illustrating another structure example of the image bearing member of the present disclosure.

FIG. 2 is a cross section illustrating another structure example of the image bearing member of the present disclosure in which a charge generating layer 35 mainly made of a charge generating material and a charge transport layer 37 mainly made of a charge transport material are laminated on the electroconductive substrate 31. Furthermore, the cross-linked surface layer 39 is provided on the charge transport layer 37.

Electroconductive Substrate

The electroconductive substrate 31 can be formed by using a material having a volume resistance of not greater than $10^{10}$ Ω·cm. For example, there can be used plastic or paper having a film form or cylindrical form covered with metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Furthermore, a tube which is manufactured from the board mentioned above by a crafting technique such as extruding and extracting and surface-treatment such as cutting, super finishing and grinding is also usable. In addition, an endless nickel belt and an endless stainless belt described in JP-S52-36016-A can be used as the electroconductive substrate 31.

An electroconductive substrate formed by applying to the substrate mentioned above a liquid application in which electroconductive powder is dispersed in a suitable binder resin can be used as the electroconductive substrate 31 for use in the present disclosure. Specific examples of such electroconductive powders include, but are not limited to, carbon black, acetylene black, metal powder, such as powder of aluminum, nickel, iron, nichrome, copper, zinc and silver, and metal oxide powder, such as electroconductive tin oxide powder and ITO powder. Specific examples of the binder resins which are used in combination with the electroconductive powder include, but are not limited to, thermoplastic resins, thermosetting resins, and optical curing resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin. Such an electroconductive layer can be formed by dispersing the electroconductive powder and the binder resins mentioned above in a suitable solvent, for example, tetrahydrofuran (THF), dichloromethane (MDC), methyl ethyl ketone (MEK), and toluene and applying the resultant to an electroconductive substrate.

In addition, an electroconductive substrate formed by providing a heat contraction tube as an electroconductive layer on a suitable cylindrical substrate can be suitably used as the electroconductive substrate 31 of the present disclosure. The heat contraction tube is formed of material such as polyvinyl chloride, polypropylene, polyester, polystyrene, polyvinylidene chloride, polyethylene, chloride rubber, and TEFLON®, which includes the electroconductive powder mentioned above.

Photosensitive Layer

Next, the photosensitive layer is described.

The photosensitive layer includes a single layer structure photosensitive layer containing a charge generating material and a charge transport material as illustrated in FIG. 1 and a laminate structure photosensitive layer formed of a charge generating layer and a charge transport layer as illustrated in FIG. 2. First the laminate structure photosensitive layer is described.

Charge Generating Layer

The charge generating layer 35 is a layer mainly formed of a charge generating material. Known charge generating material can be used in the charge generating layer 35 and inorganic material and organic material can be used as the charge generating material.

Specific examples of the inorganic materials include, but are not limited to, crystal selenium, amorphous-selenium, selenium-tellurium-halogen, selenium-arsenic compounds, and amorphous-silicon. With regard to the amorphous-silicon, those in which a dangling-bond is terminated with a hydrogen atom or a halogen atom, and those in which boron atoms or phosphorous atoms are doped are preferably used. Specific examples of the organic materials include, but are not limited to, monoazo pigments; disazo pigments; trisazo pigments; pelylene pigments; perylone pigments; quinacridone pigments; quinone-based condensed polycyclic compounds; squaric acid dyes; phthalocyanine pigments, for example, metal phthalocyanine and metal-free phthalocyanine; naphthalocyanine pigments, azulenium salt dyes; squaric acid methine pigments; azo pigments having a carbazole skeleton; azo pigments having a triphenylamine skeleton; azo pigments having a diphenylamine skeleton; azo pigments having a dibenzothiophene skeleton; azo pigments having a fluorenone skeleton; azo pigments having an oxadiazole skeleton; azo pigments having a bis-stilbene skeleton; azo pigments having a distilyloxadiazole skeleton; azo pigments having a distylylcarbazole skeleton; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, and bisbenzimidazole pigments. These charge generating materials can be used alone or as a mixture of two or more.

The charge generating layer is typically manufactured by a vacuum thin layer formation method or a casting method using a liquid dispersion system.

Specific examples of the vacuum thin layer formation methods include, but are not limited to, a vacuum evaporation method, a glow discharge decomposition method, an ion-plating method, a sputtering method, a reactive sputtering method, or a CVD method. The inorganic material and organic material specified above can be suitably used in these methods.

In addition, to provide a charge generating layer by the casting method described later, the charge generating layer 35 is formed by dispersing a charge generating material and an optional binder resin in a suitable solvent using a ball mill, an attritor, a sand mill, a bead mill, or ultrasonic, applying the liquid dispersion to the electroconductive substrate 31 followed by drying.

Specific examples of such resins include, but are not limited to, polyamides, polyurethanes, epoxy resins, polyketones, polycarbonates, silicone resins, acrylic resins, polyvinyl butyrals, polyvinyl formals, polyvinyl ketones, polystyrenes, polysulfones, poly-N-vinyl carbazoles, polyacrylic amides, polyvinyl benzales, polyesters, phenoxy resins, copolymers of vinyl chloride and vinyl acetate, polyvinyl acetate, polyphenylene oxides, polyamides, polyvinyl pyridines, cellulose resins, caseins, polyvinyl alcohols, and polyvinyl pyrolidones. These binder resins may be used alone or may be used as a mixture of two or more. The content of the binder resin is from 0 to 500 parts by weight and preferably from 10 to 300 parts by weight based on 100 parts by weight of the charge generating material. The binder resin can be added before or after dispersion of the charge generating material.

In addition to the binder resins specified above for the charge generating layer, polymerizable charge transport material having a charge transport function, for example, polycarbonate resins, polyester resins, polyurethane resins, polyether resins, polysiloxane resins or acrylic resins having an arylamine skeleton, a benzidine skeleton, a hydrazone skeleton, a carbazole skeleton, a stilbene skeleton, or a pyrazoline skeleton; and polymerizable material having a polysilane skeleton, can be also used.

The charge generating layer optionally contains a charge transport material having a low molecular weight.

The charge transport material having a low molecular weight which can be used in combination in the charge generating layer is classified into positive hole transport material and electron transport material.

Specific examples of such electron transport materials include, but are not limited to, electron acceptance material such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, and diphenoquinone derivatives. These charge transport material can be used alone or in combination.

The following electron donating material can be suitably used as the positive hole transport material. Specific examples of the positive hole transport materials include, but are not limited to, poly-N-vinylvarbazole) and derivatives thereof, poly-γ-carbzoyl ethylglutamate) and derivatives thereof, pyrenne-formaldehyde condensation products and derivatives thereof, polyvinylpyrene, polyvinyl phnanthrene, polysilane, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives, and other knoan materials. These positive hole transport materials can be used alone or in combination.

Specific examples of the solvents for use in preparation of the charge generation layer 35 include, but are not limited to, isopropanol, acetone, methylethylketone, cyclohexanone, tetrahydrofuran, dioxane, dioxolan, tolene, ethylcellosolve, ethyl acetate, methylacetate, dichloromethane, dichloroethane, monochlorobenzene, cyclohexane, xylene, ligroin, cyclopentanone, anisol, xylene, and butyl acetate. Among these, ketone based solvents, ester based solvents, and ether based solvents are preferably used. These can be used alone or as a mixture of two or more.

Liquid application of the charge generating layer 35 is prepared by dispersing a charge generating material with an optional binder resin in a solvent with a known dispersion method such as a ball mill, an attritor, a sand mill, a bead mill, or ultrasonic followed by suitable dilution. The liquid application of the charge generating layer 35 is mainly formed of a charge generating material, a solvent, and a binder resin and may also contain additives such as a sensitizer, a dispersion agent, a surface active agent, and a leveling agent such as Silicon oil (e.g., dimethylSilicon oil and methylphenyl Silicon oil). Known methods such as a dip coating method, a spray coating method, a bead coating method, a nozzle coating method, a spinner coating method, and a ring coating method can be used as the application method of the liquid application.

The thickness of the charge generating layer 35 is suitably from about 0.01 to about 5 μm and preferably from 0.1 to 2 μm.

Charge Transport Layer

The charge transport layer 37 is mainly formed of a charge transport material and a charge generating material. The content of the charge transport material in the charge transport layer 37 is preferably from 20 to 300 parts by weight based on 100 parts of the binder resin and more preferably from 30 to 200 parts by weight. When the content of the charge transport material is too small, the electric characteristics tend to deteriorate, for example, the residual voltage rises. When the content is too large, the mechanical characteristics such as abrasion resistance easily deteriorates.

When a charge transport polymer is used, it can be used alone or in combination with the binder resin.

Specific examples of the charge transport material for use in the charge transport layer 37 includes the following.

The charge transport material is typified into positive hole transport materials and electron transport materials.

As the charge transport material, for example, the electron acceptance materials specified above as the charge transport material that can be added to the charge generating layer are included.

In addition to the electron transport materials specified above that can be added to the charge generating layer, specific examples of the electron transport materials include, but are not limited to, known materials such as poly-N-vinyl carbazole and derivatives thereof, poly-γ-carbazolyl ethyl glutamate and derivatives thereof, condensed products of pyrene-formaldehyde and derivatives thereof, polyvinyl pyrene, polyvinyl phenanthrene, and polysilane.

Also, it is possible to use the charge transport polymers having a charge transport function specified above that can be added to the charge generating layer as the charge transport layer. Using such a charge transport polymer is particularly suitable to reduce dissolution of the charge transport layer when the cross-linked surface layer is coated.

These charge transport materials may be used alone or in combination.

Specific examples of the binder resins forming the charge transport layer include, but are not limited to, thermoplastic resins or thermosetting resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin.

With regard to the charge transport layer 37, the liquid application thereof can be prepared by dissolving the charge transport material and the binder resin in a solvent.

Specific examples of the solvent for use in the liquid application for forming the charge transport layer 37 include, but are not limited to, tetrahydrofuran, dioxane, toluene, dichloromethane, monochlorobenzene, dichloroethane, cyclohexanone, methylethylketone, acetone, dioxolan, cyclopentanone, anisole, xylene, ethyl acetate, and butyl acetate. These solvents can be used alone or in combination.

Known methods such as a dip coating method, a spray coating method, a bead coating method, a nozzle coating method, a spinner coating method, and a ring coating method can be used as the application method of the liquid application.

In addition, a plasticizing agent and/or a leveling agent can be added, if desired.

Known plasticizers, for example, dibutyl phthalate and dioctyl phthalate, can be used as the plasticizers. Its content is suitably from 0 to about 30 parts by weight based on 100 parts by weight of the binder resin.

Specific examples of the leveling agent for use in the charge transport layer include, but are not limited to, Silicon oils, for example, dimethyl Silicon oil and methyl phenyl Silicon oil, and polymers or oligomers having perfluoroalkyl groups in its side chain. The addition amount of the leveling agent is preferably from 0 to about 1 part by weight based on 100 parts by weight of the binder resin.

The thickness of the charge transport layer is preferably 50 μm or less and more preferably 25 μm or less in terms of the resolution and response. Although depending on the property (charging voltage in particular) of the system, the lower limit is preferably 5 μm or more.

Single Layered Photosensitive Layer

The case in which the photosensitive layer having a single layer structure as shown in FIG. 1 is described next.

The photosensitive layer having a single layer structure has both the charge generation feature and the charge transport feature simultaneously.

The photosensitive layer 33 is formed by dissolving or dispersing the charge generating material, the charge transport material, and the binder resin described above in a suitable solvent followed by application and drying. Plastic agents leveling agents and anti-oxidants are optionally added.

The same dispersion method of the charge generating material, the same charge generating material, the same charge transport material, the same plastic agent, and the same leveling agent as specified for the charge generating layer and the charge transport layer can be used. In addition to the binder resin specified for the charge transport layer, the binder resin specified for the charge generating layer can be mixed for use. Moreover, charge transport polymers can be also used to reduce mingling of the photosensitive layer compositions to the cross-linked surface layer.

In the case of the photosensitive layer 33 having a single layer structure, the charge transport material specified above is preferably used in combination as the charge transport material to improve the sensitivity.

In the photosensitive layer 33 having a single layer structure, the content of the charge generating material is from 0.1% to 30% by weight and preferably from 0.5% to 5% by weight based on the amount of the entire photosensitive layer. When the density of the charge generating material is too low, the photosensitivity tends to deteriorate. When the density of the charge generating material is too high, the chargeability and the strength of the film tend to decrease.

The content of the charge transport material is from 30 parts to 200 parts by weight based on 100 parts by weight of the binder resin. The content of the charge transport material is from 30 to 200 parts by weight based on 100 parts by weight of the binder resin.

The thickness of the photosensitive layer is preferably 50 μm or less and more preferably 25 μm or less in terms of the resolution and response. Although depending on the property (charging voltage in particular) of the system, the lower limit is preferably 5 μm or more.

Cross-Linked Surface Layer

Next, the cross-linked surface layer is described.

The cross-liked surface layer is provided to protect the photosensitive layer from abrasion and scar due to mechanical hazard to the image bearing member during actual printing.

The surface layer 39 of the image bearing member has a cross-linked surface layer that contains at least a cross-linked polymer and a compound (first compound) (charge transport material) represented by the following chemical structure I and or a compound (second compound) (charge transport material) having a triphenyl amine structure represented by the following chemical structure II. The combination of the cross-linked polymer and the compound (charge transport material) represented by the following chemical structure I is described next.

Chemical structure I

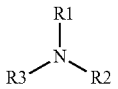

In the chemical structure I, R1 to R3 independently represent phenyl groups, biphenly groups, and condensed polycyclic hydrocarbon groups all of which may have one of the substitution groups of an alkyl group having one to four carbon atoms, an alkoxy group having one to four carbon atoms, and a halogen atom. In addition, at least one of R1 to R3 is the condensed polycyclic hydrocarbon group that may have one of the substitution groups of an alkyl group having one to four carbon atoms, an alkoxy group having one to four carbon atoms, and a halogen atom.

Specific examples of the halogen atom include a chlorine atom, a bromine atom, and a fluorine atom. In addition, the alkyl group having one to four carbon atoms is preferably a methyl group and the alkoxy group having one to four carbon atoms is preferably a methoxy group.

Specific examples of the compound represented by the chemical structure I includes, but are not limited to, the following.
Chemical structures 1
(No.1)
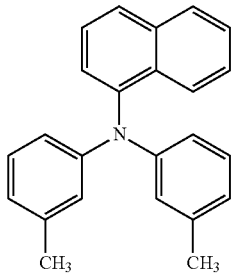
(No.2)
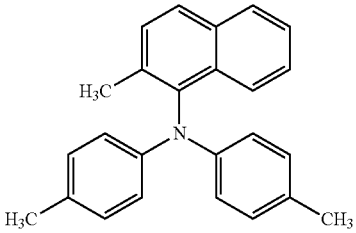
(No.3)
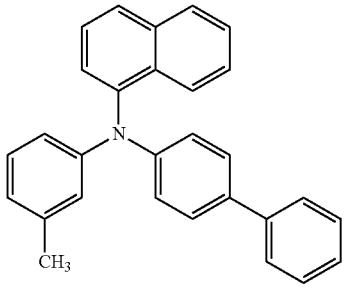
(No.4)
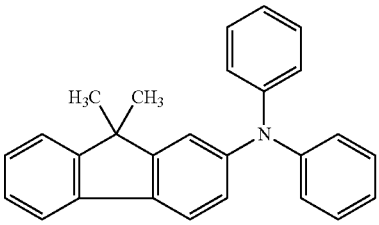
(No.5)
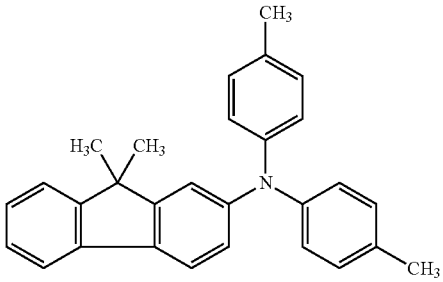
-continued
(No.6)
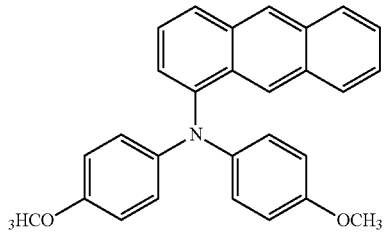
(No.7)
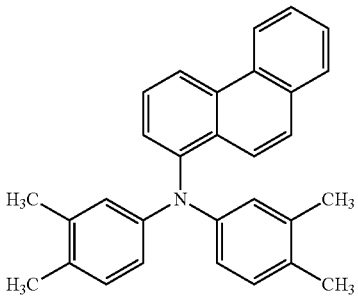
(No.8)
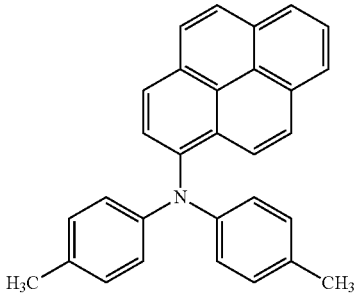
(No.9)
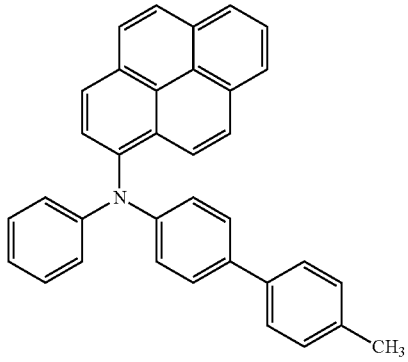
(No.10)
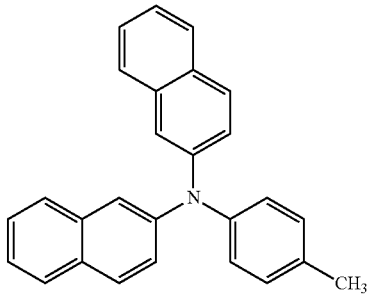

-continued (No.11)

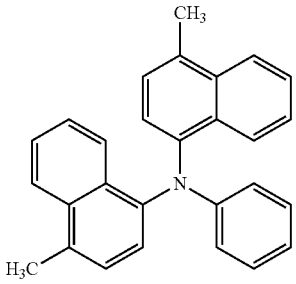

(No.12)

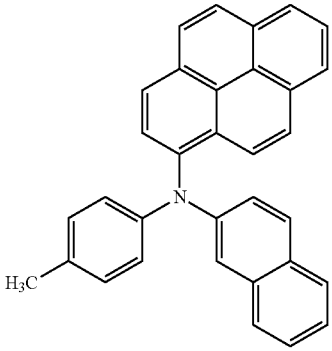

(No.13)

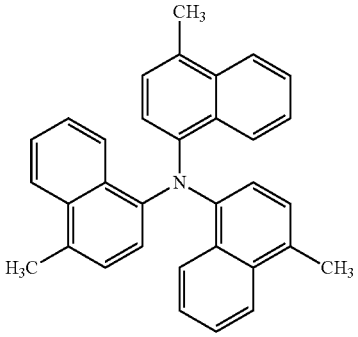

(No.14)

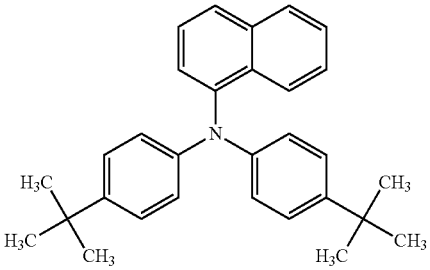

(No.15)

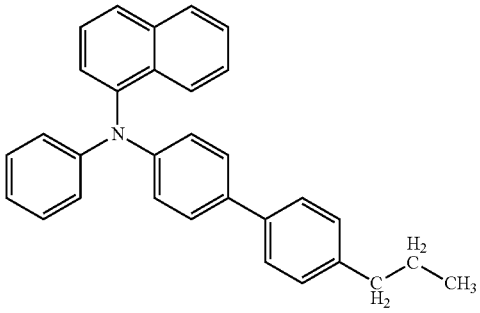

-continued (No.16)

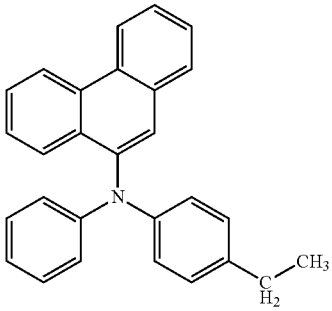

(No.17)

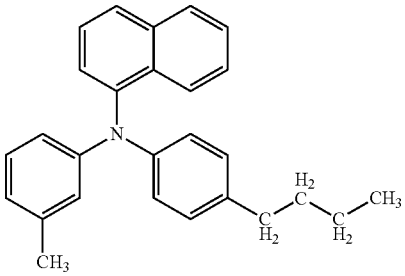

(No.18)

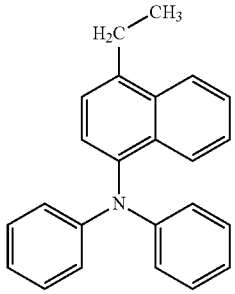

(No.19)

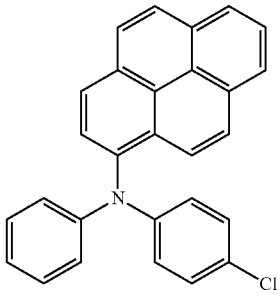

The cross-linked surface layer 39 is formed in the cross-linking reaction conducted upon application of irradiation of thermoenergy, light energy, and electron beams. Preferably, the resin cross-linked by light energy or electron beams forms a film having a high hardness and high elasticity.

In the Chemical structure I, a compound having a triphenyl amine skeleton in which all of R1 to R3 are phenyl groups has a charge transport property, which can be suitably used as the charge transport material for an image bearing member. However, compounds having a triphenyl amine skeleton are easily subjected to chemical reaction upon irradiation of theremoenergy, light energy, or electron beams, which leads to decomposition and structural change. When forming an optically cross-linked surface layer that contains a charge transport material, the charge transport material changes, for example, decomposes as described above in the cross-linked surface layer so that compounds having different energy levels are present in the film. Such materials cause changes in the characteristics of the image bearing member over time of use. For example, the charging voltages decreases, the voltage at irradiated portions changes, the dissolution deteriorates (image blur) due to decrease of the surface resistance, etc.

If the compound (charge transport material) in which at least one of R1 to R3 is a condensed polycyclic hydrocarbon group that may have one of the substitution groups of an alkyl group having one to four carbon atoms, an alkoxy group having one to four carbon atoms, and a halogen atom is used, such chemical reaction does not easily occur upon irradiation of light energy or electron beams. Therefore, a suitable surface layer is formed without the characteristic changes of the image bearing member described above.

In addition, when all the charge transport materials contained in the cross-linked surface layer 39 have a cross-linking reactive group, the charge transport material cross-links by the cross-linking reaction. Therefore, the charge transport material loses its freedom of moving, which is thought to lead to degradation of the charge transport function. When the charge transport material is caused to remain non-cross-linked by reducing the energy amount of irradiation light and electron beams to secure the freedom of moving of the charge transport material, the cross-linking density of the cross-linked film and the abrasion resistance are thought to reduce. In addition, when the charge transport material remains non-cross-linked in the cross-liked surface layer, the image bearing member is easily degraded by corona products (e.g., oxidized gas) discharged from the charger over time of use because the cross-linking reactive group has a high polarity and is easily adsorbed or reacts with oxidized gas. This causes image blur due to variance of the voltage at the irradiated portion or decrease of the resistance caused by charge trap so that it is thought to be impossible to maintain the electrostatic stability over a long period of time.

Next, the case in which the cross-linked surface layer of the present disclosure contains at least the cross-linked polymer and the second compound illustrated by Chemical structure II is described. The second compound may be taken in the cross-linked polymer (i.e., the cross-linked polymer contains portions deriving from the second compound having a triphenyl amine structure).

Chemical structure II

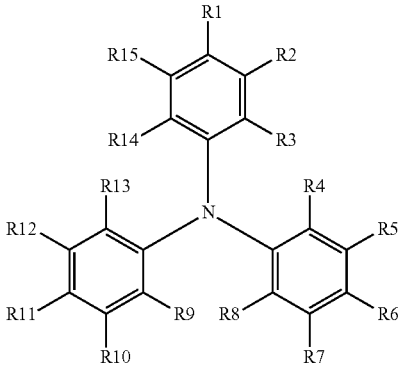

In Chemical structure II, R3, R4, R8, R9, R13, and R14 independently represent hydrogen atoms, halogen atoms, alkyl groups, alkoxy groups, or aryl groups excluding the case in which all are hydrogen atoms. R1, R2, R5, R6, R7, R10, R11, R12, and R15 independently represent hydrogen atoms, halogen atoms, substituted or non-substituted alkyl groups, substituted or non-substituted alkoxy groups, substituted or non-substituted aralkyl groups, substituted or non-substituted aryl groups, substituted or non-substituted alkylene groups, cyano groups, nitro groups, or —OCO═$CH_2$R16. R16 represents a hydrogen atom, a substituted or non-substituted alkyl group, a substituted or non-substituted alkoxy group, or a substituted or non-substituted aryl group.

The compound represented by Chemical structure II has a charge transport function and is suitably used as a charge transport material for an image bearing member. However, the compound represented by Chemical structure II is extremely reactive upon application of thermal energy, light energy, and electron beams. In particular, the compound tends to be reactive at the ortho positions to nitrogen, i.e., R3, R4, R8. R13, and R14. When all of these are hydrogen atoms, the compound reacts at the ortho positions to form a carbazole structure, meaning that the characteristics change. If such compounds having changed characteristics are contained in the film, the charge transport structure thereof changes, resulting in an increase of charge trap.

If the compound having a triphenyl amine structure has a phenyl group having a substitution group at an ortho position to the nitrogen atom, the bonding of the phenyl groups at the ortho positions adjacent in the compound having a triphenyl amine structure is inhibited, which makes chemical reaction difficult. Therefore, the charge transport function remains unchanged so that the charge trap does not easily increase. In addition, since the substitution groups at the ortho positions are present between the two phenyl groups, the phenyl groups at the ortho positions do not have a great impact on bulkiness of the entire compound relative to the substitution groups at para positions or metha positions. Therefore, the substitution groups at the ortho positions do not inhibit development of the three-dimensional network structure of a cross-linked resin (polymer) described later. Furthermore, when the substitution group at the ortho position is an electron releasing substitution group, the charge density of the phenyl group increases, thereby improving the charge transport function. If the number of substitution groups attached to the phenyl group increases, the degree of contact between the charge transport structure portions of the adjacent compounds having triphenyl amine structure decreases, which causes charge trap. Therefore, it is preferable that the phenyl group having a substitution group at the ortho position does not have any other substitution groups and one or two of the phenyl groups linked to the nitrogen atom have a single substitution group at the ortho position.

In addition, in the compound having a triphenyl amine structure, one of the phenyl groups different from the phenyl group having a substitution group at an ortho position preferably has a functional group reactive with a binder resin. By having such a functional group reactive to a binder resin, the compound is taken in the three-dimensional network structure of the binder resin upon irradiation of thermal energy, light energy, and electron beams, thereby improving the mechanical strength.

Specific examples of such reactive functional groups include, but are not limited to, acryloyloxy groups and methacryloyloxy groups. In particular, acryloyloxy groups are preferable.

Furthermore, it is preferable that the compound having a triphenyl amine structure does not absorb light having a wavelength of 350 nm or longer. If the compound having a triphenyl amine structure does not absorb light energy for cross-linking, the compound does not inhibit light absorption by a photo polymerization initiator so that the cross-linking reaction undergoes efficiently. In addition, cross-linking proceeds not only from the surface of the cross-linked surface layer but also from the inside thereof. Therefore, a uniform cross-linked surface layer having a high cross-linking density can be formed, thereby improving the mechanical strength.

The measuring method of the absorption spectrum is described next.

First, 3 mg of the compound having a triphenyl amine structure illustrated by Chemical structure II is dissolved in 1,000 ml of teterahydrofuran followed by measuring by an ultraviolet, visible light, near infrared spectrophotometer (UV-3600, manufactured by Shimadzu Corporation) using a solution technique. Absorbency 0.1 or greater is defined as absorbency and, less than 0.1, no-absorbency for light having a wavelength of 350 nm.

Specific examples of the compound having a triphenyl amine structure illustrated by Chemical structure II contained in the cross-liked surface layer include, but are not limited to, the following.

Chemical structures 2

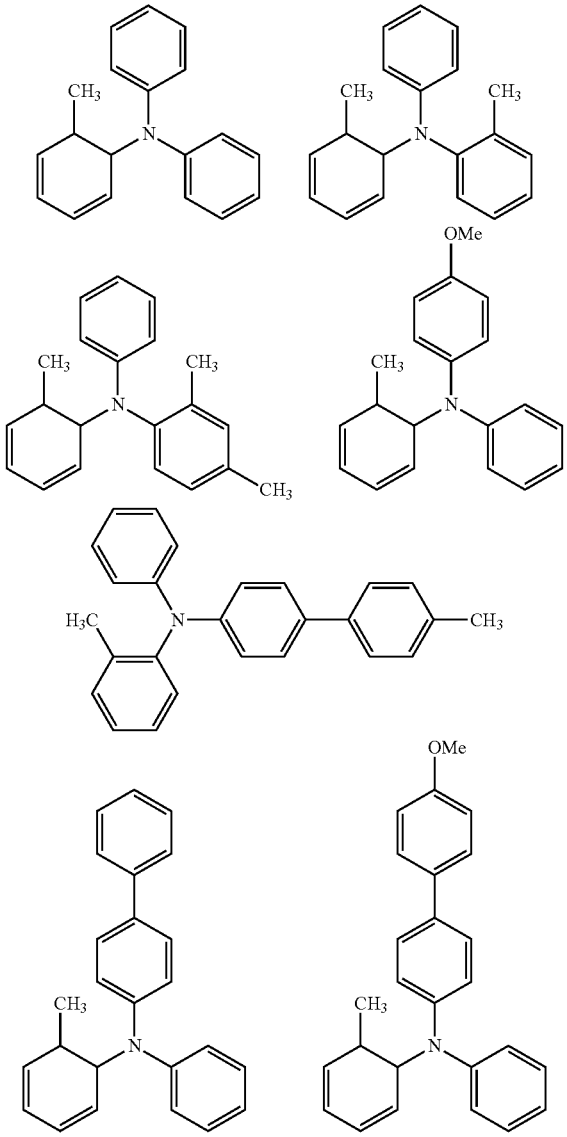

-continued

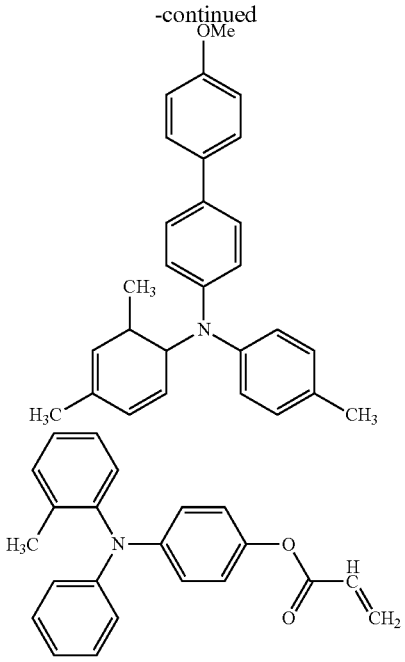

The content of the compound illustrated by Chemical structure I or II is from 10% to 70% by weight and preferably from 30% to 60% by weight based on the total of the cross-linked surface layer 39.

Cross-Linked Polymer

Specific examples of the cross-linked polymers (polymerizable compounds upon irradiation of light energy or electron beams) for use in the cross-linked surface layer 39 include, but are not limited to, trimethylol propane triacrylate (TMPTA), trimethylol propane trimethacrylate, HPA modified trimethylol propane triacrylate, EO modified trimethylol propane triacrylate, PO modified trimethylol propane triacrylate, caprolactone modified trimethylol propane triacrylate, HPA modified trimethylol propane trimethacrylate, pentaerythritol triacrylate, pentaerythritol tetra acrylate (PETTA), glycerol triacrylate, ECH modified glycerol triacrylate, EO modified glycerol triacrylate, PO modified glycerol triacrylate, tris (acryloxyrthyl)isocyanulate, dipenta erythritol hexacrylate (DPHA), caprolactone modified dipenta erythritol hexacrylate, dipenta erythritol hydroxyl dipenta acrylate, alkylized dipenta erythritol tetracrylate, alkylized dipenta erythritol triacrylate, dimethylol propane tetracrylate (DTMPTA), penta erythritol ethoxy tetracrylate, EO modified phosphoric acid triacrylate, and 2,2,5,5-tetrahydroxy methyl cyclopentanone tetracrylate. These can be used alone or in combination.

Radical polymerizable monomers are preferably cross-linked upon irradiation of light energy or electron beams. Light energy or electron beams transmit into the inside of the cross-linked surface layer so that the cross-linking reaction undergoes from the inside of the cross-linked surface layer and the cross-linked surface layer has a high hardness and high elasticity.

Photo Polymerization Initiator

It is preferable to use a photo polymerization initiator to efficiently conduct cross-linking reaction upon irradiation of light energy or electron beams.

Specific examples of photopolymerization initiators include, but are not limited to, an acetophenon based or ketal based photopolymerization initiators such as diethoxy acetophenone, 2,2-dimethoxy-1,2-diphenyl ethane-1-on, 1-hydroxy-cyclohexyl-phenyl-ketone, 4-(2-hydroxyethoxy) phenyl-(2-hydroxy-2-propyl)ketone, 2-benzyl-2-dimethylamino-1-(4-morpholinophenyl)butanone-1,2-hydroxy-2-methyl-1-phenyl propane-1-on, and 1-phenyl-1,2-propanedion-2-(o-ethoxycarbonyl)oxime; a benzoine ether based photopolymerization initiator such as benzoine, benzoine methyl ether, benzoine ethyl ether, benzoine isobutyl ether, and benzoine isopropyl ether; a benzophenone based photopolymerization initiator such as benzophenone, 4-hydroxy benzophenone, o-benzoyl methyl benzoate, 2-benzoyl naphthalene, 4-benzoyl biphenyl, 4-benzoyl phenyl ether, acrylizes benzophenone and 1,4-benzoyl benzene; a thioxanthone based photopolymerization initiator such as 2-isopropyl thioxanthone, 2-chlorothioxanthone, 2,4-dimethyl thioxanthone, 2,4-diethyl thioxanthone, and 2,4-dichloro thioxanthone; and other photopolymerization initiators such as ethyl anthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxybenzoyl)-2,4,4-trimethyl pentyl phosphine oxide, a methylphenyl glyoxy ester, 9,10-phenanthrene, an acridine based compound, a triadine based compound and an imidazole based compound. In addition, a compound having an acceleration effect on photopolymerization can be used alone or in combination with the photopolymerization initiator. Specific examples of such compounds include, but are not limited to, triethanol amine, methyl diethanol amine, 4-dimethyl amino ethyl benzoate, 4-dimethyl amino isoamyl benzoate, ethyl benzoate (2-dimethyl amino), and 4,4'-dimethyl amino benzophenone.

These polymerization initiators can be used alone or in combination. The content of the photopolymerization initiator is from 0.5% to 40% by weight and preferably from 1% to 20% by weight based on the cross-linking polymerizable monomer.

Inorganic Particulate

With regard to the image bearing member of the present disclosure, filler materials can be contained therein to improve the mechanical strength of the cross-linked surface layer 39. Specific examples of the organic filler material include, but are not limited to, powder of fluorine resin such as polytetrafuloroethylene, powder of silicone resin, and powder of a-carbon. Any known inorganic particulate can be suitably used. Specific examples thereof include, but are not limited to, titanium oxide, tin oxide, zinc oxide, zirconium oxide, indium oxide, antimony oxide, boron nitride, silicon nitride, calcium oxide, barium sulfide, ITO, silicon oxide, colloidal silica, aluminum oxide, bismuth oxide, tin oxide to which antimony is doped, indium oxide to which tin is doped, powder of metal such as copper, tin, aluminum, and indium, and potassium titanate. Taking into consideration the electric characteristics of the cross-linked surface layer 39, aluminum oxide, titanium oxide, silicon oxide, and tin oxide are suitably used.

In addition, the average primary particle diameter of the filler is preferably from 0.01 μm to 0.5 μm in terms of optical transmittance and durability of the surface layer. When the average particle diameter of the filler is too small, the dispersion property and the durability such as abrasion resistance tend to deteriorate. When the average particle diameter of the filler is too large, the surface roughness of the surface layer tends to increase, which accelerates abrasion of the blade cleaning member described later so that cleaning performance soon deteriorates and toner filming occurs. In addition, although depending on the specific gravity of the filler particulates, the sedimentation of the filler in the liquid dispersant is accelerated, which may result in a short working life of liquid application.

Abrasion resistance is improved as the filler material density in the cross-linked surface layer 39 increases. However, a filler material density that is too high tends to raise a residual voltage and degrade the transmission factor of writing light for a protection layer, which may cause side-effects. Therefore, the content ratio of the filler material is generally not greater than 50% by weight, and preferably not greater than 30% by weight based on all the solid portion Formation of Cross-Linked Surface Layer The cross-linked surface layer is formed by application of liquid application containing at least the polymerizable compound (cross-linking polymerizable monomer) described above and the compound (charge transport material) illustrated by Chemical structure I or II followed by curing thereof. When the components of the cross-linked surface layer are liquid at room temperature, other components can be dissolved therein before coating the application of the liquid. Optionally, the liquid application is diluted by a suitable solvent before coating.

Specific examples of such solvents include, but are not limited to, alcohols such as methanol, ethanol, propanol, and butanol; ketones such as acetone, methyl ethyl ketone, methyl isobutyl ketone, and cycle hexanone; esters such as ethyl acetate and butyl acetate; ethers such as tetrahydrofuran, dioxane and propyl ether; halogen based solvents such as dichloromethane, dichloroethane, trichloroethane, and chlorobenzene; aromatic series based solvents such as benzene, toluene, and xylene; cellosolve based solvents such as methyl cellosolve, ethyl cellosove, and cellosolve acetate; and dioxolane, cyclopentanone, and anisole.

These solvents can be used alone or in combination.

The dilution ratio by using such a solvent is arbitrary and varies depending on the solubility of a composition, a coating method, and a target layer thickness. A dip coating method, a spray coating method, a bead coating method, a ring coating method, etc., can be used in application of the liquid application.

In the present disclosure, the liquid application is applied and energy is provided from outside to cure the surface layer. Light energy and electron beams can be used as the energy provided from outside. However, the electron beams may damage the constitution materials in the image bearing member due to energy penetration depth and energy intensity thereof. Therefore, light energy is preferable. Heat energy can be used in combination.

As the light energy, a UV irradiation light source such as a high pressure mercury lamp or a metal halide lamp having an emission wavelength mainly in the ultraviolet area is used. A visible light source can be selected according to the absorption wavelength of a radical polymerizable compound and a photopolymerization initiator. In addition, the cross-linking reaction by the radical polymerization is greatly affected by the temperature and the surface temperature of the film upon UV irradiation is preferably from 20° C. to 170° C. There is no specific limit to the selection of the surface temperature control device for the film. A method of controlling the surface temperature using a thermal medium is preferable as long as the temperature range is maintained.

Furthermore, the liquid application for use in formation of the cross-linked surface layer for use in the present disclosure optionally includes additives such as plasticizers (for reducing internal stress or improving adhesiveness) and leveling agents. Known additives can be used as these additives. A typical resin such as dibutylphthalate and dioctyl phthalate can be used as the plasticizer. The content thereof is not greater than 20% by weight and preferably not greater than 10% based on the total solid portion of the liquid application. Silicon oils such as dimethyl silicon oil, methyl phenyl silicon oil and a polymer or an oligomer having a perfluoroalkyl group in its side chain can be used as the leveling agent. The content thereof is suitably not greater than 3% by weight based on the total solid portion of the liquid application.

The cross-linked surface layer of the present invention preferably has a thickness of from 1 μm to 30 μm, more preferably from 2 μm to 20 μm, and furthermore preferably from 4 μm to 15 μm.

When the surface layer is too thin and carriers are attached and buried therein, the durability of the cross-linked surface layer is not easily secured. To the contrary, a surface layer that is too thick tends to cause a problem such as a rise in the residual voltage. Therefore, it is preferable to form a cross-linked surface layer having a suitable thickness by which prevention against abrasion and scar is secured and a residual voltage is reduced.

Intermediate Layer

In the image bearing member of the present disclosure, an intermediate layer can be provided between the photosensitive layer (the single layer type photosensitive layer 33 or the charge generating layer 35) and the cross-linked surface layer. Generally, the intermediate layer is mainly formed of a binder resin. Specific examples of the binder resins include, but are not limited to, polyamide, alcohol soluble nylon, water soluble polyvinylbutyral, polyvinyl butyral, and polyvinyl alcohol. The intermediate layer can be formed by any application method described above. The thickness of the intermediate layer is suitably from about 0.05 μm to about 2 μm.

Undercoating Layer

In the image bearing member of the present disclosure, an undercoating layer can be provided between the electroconductive substrate 31 and the photosensitive layer (the single layer type photosensitive layer 33 or the charge generating layer 35). Typically, such an undercoating layer is mainly made of a resin. Considering that liquid of a photosensitive layer is applied to such an undercoating layer (i.e., resin), the resin is preferably insoluble in a known organic solvent. Specific examples of such resins include, but are not limited to, water soluble resins, such as polyvinyl alcohol, casein, and sodium polyacrylate, alcohol soluble resins, such as copolymerized nylon and methoxymethylized nylon and curing resins which form a three dimension network structure, such as polyurethane, melamine resins, phenol resins, alkyd-melamine resins and epoxy resins.

In addition, fine powder pigments of a metal oxide such as titanium oxides, silica, alumina, zirconium oxides, tin oxides, and indium oxides can be added to the undercoating layer to prevent moiré and reduce the residual voltage.

The undercoating layer described above can be formed by using a suitable solvent and a suitable coating method as described above for the photosensitive layer. The undercoating layer can be formed by using a silane coupling agent, a titanium coupling agent, and a chromium coupling agent, anodizing a metal oxide layer of $Al_2O_3$, or coating organic compounds such as a polyparaxylyene (parylene) or an inorganic compound such as $SiO_2$, $SnO_2$, $TiO_2$, ITO, and $CeO_2$ by a vacuum thin layer forming method. Any other known methods can be also available. The thickness of the undercoating layer is suitably from 0 to 5 μm.

Optional Additives

In the present disclosure, any known anti-oxidizing agents, plasticizers, lubricants, ultraviolet absorbers, leveling agents, etc. can be added to each of the protection layer, the charge generating layer, the charge transport layer, the undercoating layer, and the intermediate layer to improve the environmental resistance, particularly to prevent the degradation of sensitivity, and the rise in residual potential. In addition to plasticizers and leveling agents, antioxidants, lubricants, and ultraviolet absorbers can be added to the cross-linked surface layer.

Specific examples of the antioxidants include, but are not limited to, the following.

(a) Phenol Compounds 2,6-di-t-butyl-p-cresol, butylated hydroxyanisol, 2,6-di-t-butyl-4-ethylphenol, n-octadcyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, and tocopherols.

(b) Paraphenylene Diamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine (c) Hydroquinones 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, and 2-(2-octadecenyl)-5-methyl hydroquinone.

(d) Organic Sulfur Compounds dilauryl-3,3-thiodipropionate, distearyl-3,3'-thiodipropionate, and ditetradecyle-3,3f-thiodipropionate.

(e) Organic Phosphorous Compounds triphenyl phosphine, tri(nonylphenyl)phosphine, tri(dinonylphenyl)phosphine, tricresyl phosphine, and tri(2,4-dibutylphenoxy)phosphine.

The following can be used as the lubricant.

(a) Hydrocarbon-Based Compounds

Liquid paraffin, paraffin wax, microwax, and low polymerized polyethylene. Liquid paraffin, paraffin wax, microwax, and low polymerized polyethylene.

(b) Aliphatic-Based Compounds

Laurie acid, myristic acid, paltimic acid, stearic acid, arachidic acid, and behenic acid.

(c) Aliphatic Amide-Based Compounds

Stearyl amide, palmitic amide, oleic amide, methylene bis-stearoamide, and ethylene bisstaroamide.

(d) Ester Compounds

Lower alcohol ester of an aliphatic acid, multi-valent alcohol ester of an aliphatic acid, and aliphatic acid polyglycol esters.

(e) Alcohol-Based Compounds

Cetyl alcohol, stearyl alcohol, ethylene glycol, polyethylene glycol, and polyglycerol.

(f) Metal Soap

Lead stearate, cadmium stearate, barium stearate, calcium stearate, zinc stearate, and magnesium stearate.

(g) Carnauba Wax, Candelila Wax, Bees Wax, Whale Wax, Insect Wax and Montan Wax (h) Others Silicone Compounds, and Fluorinated Compounds Specific examples of the ultraviolet absorbers include, but are not limited to, the following.

(a) Benzophenone-Based Compounds 2-hydrosybenzophenone, 2,4-dihydroxybenzophenone, 2,2',4-trihydroxybenzophenone, 2,2',4,4'-tetrahydroxy benzophenone, and 2,2'-dihydroxy-4-methoxy dibenzophenone.

(b) Salkylate-Based Compounds

Phenylsalicylate, and 2,4-di-t-butylphenyl-3,5-di-t-butyl-4-hydroxybenzoate.

(c) Benzotriazoles (2'-hydroxyphenyl)benzotriazole, (2'-hydroxy-5'-methylphenyl)benzotriazole, (2'-hydroxy-5'-methyl phenyl)benzotriazole, and (2'-hydroxy-3'-tertiary butyl-5'-methylphenyl)-5-chlorobenzotriazole.

(d) Cyanoacylate-Based Compounds

Ethyl-2-cyano-3,3-diphenylacrylate, and methyl-2-carbomethoxy-3-(paramethoxy)acrylate.

(e) Quencher (Metal Complex-Based Compounds)

Nickel (2,2'-thiobis(4-t-octyl)phenolate)normalbutyl amine, nickeldibutyldithiocarbamate, nickel dibutyldithiocarbamate, and cobalt dicyclohexyldithiophosphate.

(f) HALS (Hindered Amines)

Bis(2,2,6,6-tetramethyl-4-piperidyl)cebacate, bis(1,2,2,6,6-pentamethyl-4-piperidyl)cebacate, 1-[2-[3-(3,5-di-t-butyl-4-hydroxyphenyl)propionyloxy]ethyl]-4-[3-(3,5-di-t-butyl-4-hydroxyphenyl)propionyloxy-2,2,6,6-tetramethylpyridine, 8-benzil-7,7,9,9-tetramethyl-3-octyl-1,3,8-triazaspiro[4,5]undecane-2,4-dione, and 4-benzoyloxy-2,2,6,6-tetramethyl piperidine These additives including plasticizers and laveling agents are known as additives for rubber, plastic, and oils, and commercial products thereof are readily available.

Image Forming Method and Image Forming Apparatus

The image forming method of the present disclosure uses the image bearing member (photoreceptor) of the present disclosure described above and includes processes of at least: charging the photoreceptor; irradiating the photoreceptor with light to form a latent electrostatic image; developing the latent image with toner to obtain a toner image; transferring the toner image to an image carrying body (transfer medium); optionally fixing the toner image; and cleaning the surface of the photoreceptor. The image forming apparatus of the present disclosure uses the image bearing member (photoreceptor) having the cross-linked type charge transport layer described above. The image forming apparatus has devices of: at least charging the photoreceptor; irradiating the photoreceptor with light to form a latent electrostatic image thereon; developing the latent image with toner to obtain a toner image; transferring the toner image to an image carrying body (transfer medium); optionally fixing the toner image; and cleaning the surface of the photoreceptor. The image forming apparatus of the present disclosure may employ a system which includes two or more image forming elements, each having at least a charger, an irradiator, a development device, a transfer device, and the image bearing member (photoreceptor).

Figure 4:
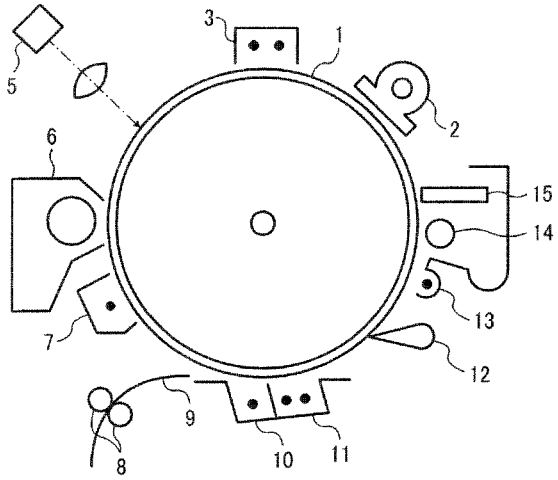
FIG. 4 is a schematic diagram illustrating an example of the image forming apparatus of the present disclosure.

FIG. 4 is a schematic diagram illustrating an example of the image forming apparatus.

A charger 3 is used as a device to charge an image bearing member (photoreceptor) 1. Specific examples of the charger 3 include, but are not limited to, a corotron device, a scorotron device, a solid discharging element, a needle electrode device, a roller charger, and an electroconductive brush device, and any known system can be used. In particular, the structure of the present disclosure is suitable for a charger employing a contact charging system or a non-contact vicinity arrangement charging system of discharging from the charger in a close range, which is a cause of decomposition of the components of the image bearing member. In the contact charging system, a charging roller, a charging brush, a charging blade, etc. directly contacts an image bearing member. In the non-contact vicinity arrangement system, for example, a charging roller is arranged not in contact with but in the vicinity of an image bearing member with a gap of 200 μm or less between the surface of the image bearing member and the charging roller. When this gap is too wide, charging tends not to be stable. When the gap is too small, the surface of the charger is possibly contaminated by toner remaining on the image bearing member. Therefore, the gap is from 10 μm to 200 μm and preferably from 10 μm to 100 μm.

Next, an image irradiation portion 5 irradiates the charged image bearing member 1 to form a latent electrostatic image thereon. Typical illumination materials, for example, a fluorescent lamp, a tungsten lamp, a halogen lamp, a mercury lamp, a sodium lamp, a light emitting diode (LED), a semiconductor laser (LD), and electroluminescence (EL) can be used as the light source of the image irradiation portion 5. Various kinds of optical filters, for example, a sharp cut filter, a band-pass filter, a near infrared filter, a dichroic filter, a coherent filter and a color conversion filter, can be used in combination with these light sources to irradiate the latent image bearing member with light having only a desired wavelength.

Next, a development unit 6 develops and visualizes the latent electrostatic image formed on the image bearing member 1. As the development method, there are a one-component developing method and a two-component development method using a dry toner and a wet-developing method using a wet toner. When the image bearing member 1 is negatively charged and irradiated, a positive latent electrostatic image is formed on the image bearing member 1 in the case of reversal development. When the latent electrostatic image is developed with a negatively charged toner (volt-detecting fine particles), a positive image is obtained. When the latent electrostatic image is developed using a positively charged toner, a negative image is obtained.

In the case of the regular development, a negative latent electrostatic image is formed on the surface of the image bearing member 1. When the latent electrostatic image is developed with a positively charged toner (volt-detecting fine particles), a positive image is obtained. When the latent electrostatic image is developed using a negatively charged toner, a negative image is obtained.

A transfer charger 10 transfers the toner image on the image bearing member 1 to a transfer medium 9. Registration rollers 8 are provided for the transfer medium 9. A pre-transfer charger 7 can be used to improve the transferring. An electrostatic transfer system using a transfer charger or a bias roller, a mechanical transfer system using an adhesive transfer method, a pressure transfer method, etc., and a magnetic transfer system can be used. The charger 3 described above can be used in the electrostatic transfer system.

A separation charger 11 and a separation claw 12 are used to separate the transfer medium 9 from the image bearing member 1. Other separation methods that can be used are, for example, electrostatic sucking induction separation, side edge belt separation, front edge grip conveyance, and curvature separation. The charger 3 described above can be used as the separation charger 11.

A fur brush 14 and/or a cleaning blade 15 are used to remove toner remaining on the image bearing member 1 after transfer.

A pre-cleaning charger 13 can be used for more efficient cleaning performance. A web system and a magnet brush system can be also used as the cleaning method. These systems can be employed alone or in combination.

A discharging unit can be optionally used to remove the latent electrostatic image on the image bearing member 1. As the discharging unit, a discharging lamp 2 or a discharging charger can be used. The irradiation light source and the charger 3 mentioned above can be used. In addition, with regard to the processes that are performed not in the vicinity of the image bearing member 1, i.e., reading an original, sheet-feeding, fixing, and paper-discharging, known devices and methods in the art can be used.

Figure 6:
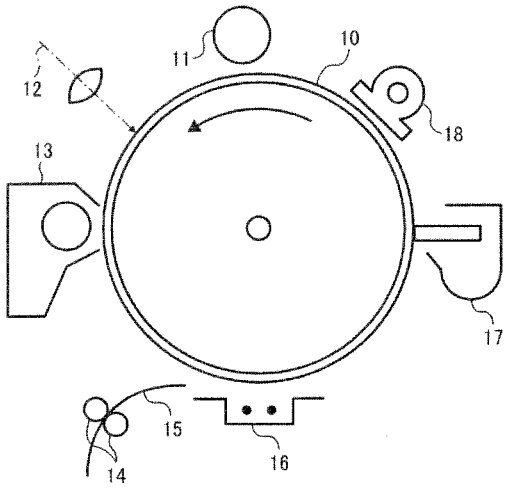
FIG. 6 is a schematic diagram illustrating another example of the image forming apparatus of the present disclosure.

FIG. 6 is a schematic diagram illustrating another example of the image forming apparatus of the present disclosure.

Figure 3:
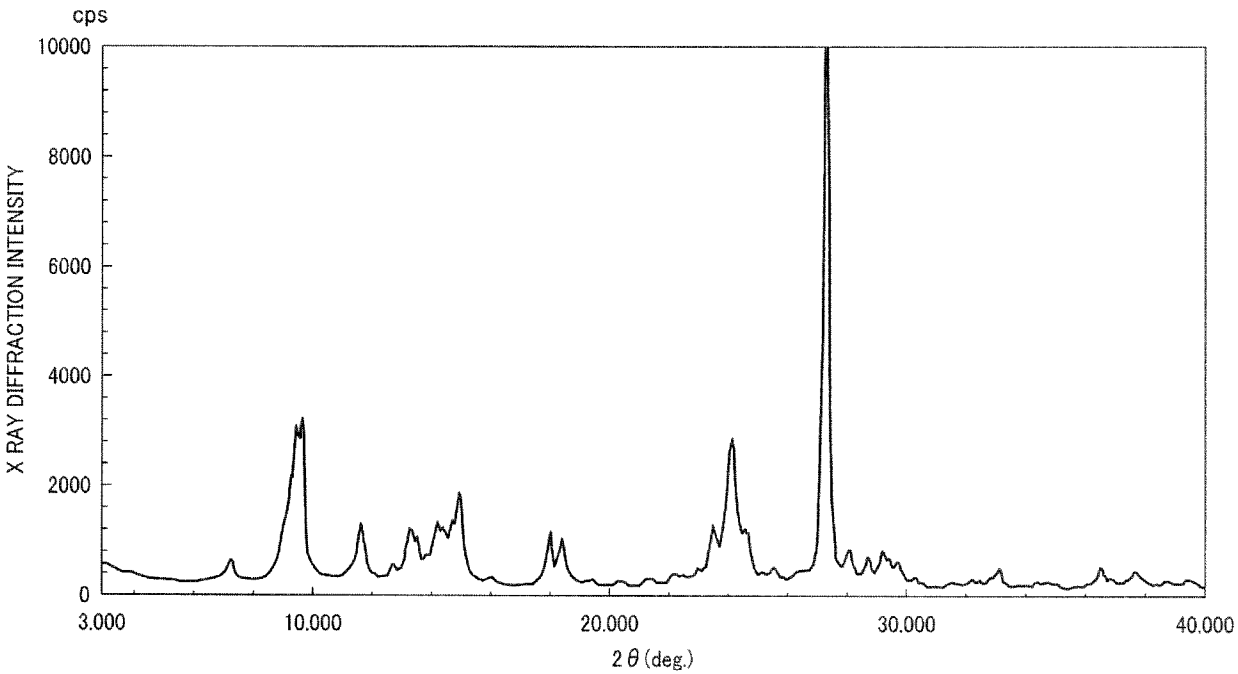
FIG. 3 is a X ray diffraction spectrum of titanylphthalocyanine powder used in Example 1 described later.

An image bearing member 10 rotates in the direction indicated by an arrow in FIG. 3. Around the image bearing member 10 are provided a charger 11, an image irradiator 12, a developing unit 13, a transfer member 16, a cleaner 17, and a discharging member 18. The cleaner 17 and the discharging member can be omitted.

The mechanism of the image forming apparatus is as follows. The charger 11 charges the surface of the image bearing member 10. Next, image light corresponding to input signals is written on the surface of the image bearing member 1 by the image irradiator 12 to form a latent electrostatic image thereon. Then, the latent electrostatic image is developed by the developing unit 13 to form a toner image on the surface of the image bearing member 10. The toner image is transferred by the transfer member 16 to a transfer medium 15 fed to the transfer position by the transfer roller 14. The toner image is fixed on the transfer medium 15 by a fixing device.

Toner that has not been transferred is removed by the cleaner 17.

Next, the charge remaining on the image bearing member 10 is neutralized (discharged) by the discharging (neutralizing) member 18

Although the image bearing member 10 has a drum form in FIG. 6, it may employ a sheet form or an endless belt form. A charging member such as a charging roller and a charging brush and any other known devices in addition to a corotron, a scorotron, and a solid state charger can be used as the charger 11 and the transfer member 16.

In addition, the light sources described above can be used as the image irradiator 12 and the discharging member 18. Among these, light emitting diodes (LED) and semiconductor lasers (LD) are commonly used.

The filters specified above can be used to radiate light having a desired wavelength.

The light source, etc. irradiates the image bearing member 10 through processes such as the transfer process, the discharging process, the cleaning process, or a pre-irradiation process in which light radiation is used in combination. However, irradiation of the image bearing member 10 in the discharging process significantly fatigues the image bearing member 10, which easily leads to reduction of charging and an increase in the residual voltage. Therefore, it is suitable in some cases to discharge the image bearing member by another method such as applying a reversed bias in the charging process or the cleaning process instead of discharging by irradiation in terms of improving the durability of the image bearing member.

When the image bearing member 10 is positively (or negatively) charged and irradiated according to image data, a positive (or negative) latent electrostatic image is formed on the image bearing member 1. When the latent electrostatic image is developed with a negatively (or positively) charged toner (volt-detecting fine particles), a positive image is formed. When the latent electrostatic image is developed using a positively (or negatively) charged toner, a negative image is formed. Any known method can be applied to such a development device and also a discharging device.

Among the contamination materials attached to the surface of the image bearing member, discharging product produced by charging and external additives contained in the toner are easily affected by moisture condition, which causes production of abnormal images. In addition, paper dust tends to degrade the durability of the image bearing member and cause non-uniform abrasion in addition to such production of abnormal images. Therefore, a structure in which the image bearing member does not directly contact paper is preferable in terms of improvement of the quality of image.

Toner that is used to develop an image on the image bearing member 10 by the development unit 13 is transferred to the transfer paper 15. However, not all of the toner is transferred but some of it remains on the image bearing member 10. Such remaining toner is removed from the image bearing member 10 by the cleaner 17. Known devices such as a cleaning blade and a cleaning brush can be used as this cleaner. These can be used in combination.

The image bearing member of the present disclosure is applicable to an image bearing member having a small diameter because the image bearing member has a high photosensitivity and stability. Therefore, in an image forming apparatus or a system in which the image bearing member described above is extremely suitably used, multiple image bearing members are arranged for corresponding development units arranged for multiple color toners to conduct processing in parallel, which is so-called an image forming apparatus employing tandem system.

The image forming apparatus employing the tandem type system includes at least four color toners of yellow (Y), magenta (M), cyan (C), and black (K) required for full color printing, development units that accommodate the toners, and at least respective four image bearing members. Therefore, this image forming apparatus enables full color printing at an extremely high speed in comparison with a typical image forming apparatus for full color printing.

Figure 7:
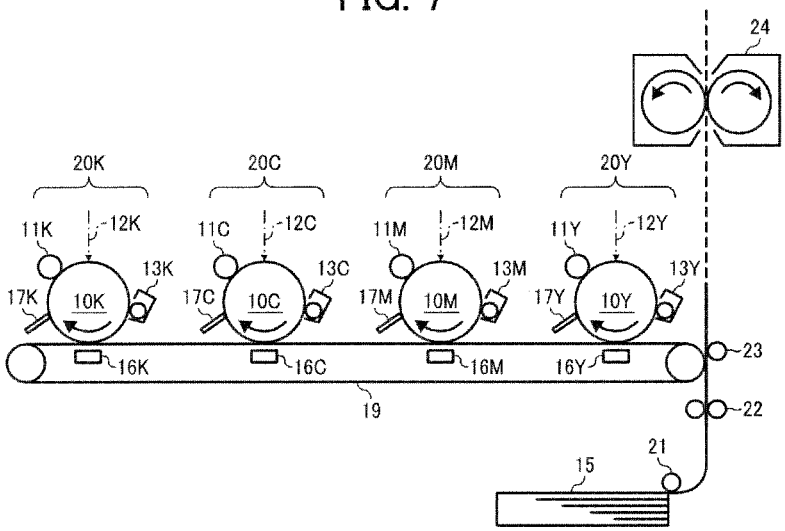
FIG. 7 is a diagram illustrating yet another example of the image forming apparatus of the present disclosure.

FIG. 7 is a schematic diagram illustrating an example of the full color image forming apparatus employing the tandem type system and the following variations are within the scope of the present disclosure.

In FIG. 7, the image bearing members 10C, 10M, 10Y, and 10K are the image bearing members 10 having a drum form and rotate in the direction indicated by an arrow. There are arranged at least chargers 11C, 11M, 11Y, and 11K, development devices 13C, 13M, 13Y, and 13K, and cleaning devices 17C, 17M, 17Y, and 17K in that order around the image bearing members 10C, 10M, 10Y, and 10K relative to the rotation direction of the image bearing members.

Laser beams 12C, 12M, 12Y, and 12K are emitted from an irradiator to irradiate the surfaces of the image bearing drum members 10C, 10M, 10Y, and 10K from the gap between the charger 11C, 11M, 11Y, and 11K and the development devices 13C, 13M, 13Y, and 13K to form latent electrostatic images on the image bearing members 10C, 10M, 10Y, and 10K. Four image formation units 20C, 20M, 20Y, and 20K including the image bearing members 10C, 10M, 10Y, and 10K are arranged along a transfer belt 25 serving as a transfer medium conveyor device.

An intermediate transfer belt 19 is in contact with the image bearing drum members 10C, 10M, 10Y, and 10K between the development device 13C, 13M, 13Y, and 13K and the corresponding cleaners 17C, 17M, 17Y, and 17K of each image formation units 20C, 20M, 20Y, and 20K. Transfer members 16C, 16M, 16Y, and 16K that apply transfer biases are provided on the side of the transfer belt 19 reverse to the side on which the image bearing members 10C, 10M, 10Y, and 10K and the intermediate transfer belt 19 are in contact. Each image formation units 20C, 20M, 20Y, and 20K is of the same structure except that toners contained in the development devices 13C, 13M, 13Y, and 13K have different colors from each other.

The color image forming apparatus having the structure illustrated in FIG. 7 produces images as follows. In the image formation units 20C, 20M, 20Y, and 20K, the image bearing members 10C, 10M, 10Y, and 10K are charged by the chargers 11C, 11M, 11Y, and 11K that are driven with the image bearing members to rotate in the direction indicated by an arrow (the same direction as the rotation direction of the image bearing members 10C, 10M, 10Y, and 10K) and irradiated with the laser beams 12C, 12M, 12Y, and 12K emitted from the irradiation device situated outside the image bearing members 10C, 10M, 10Y, and 10K to produce latent electrostatic images corresponding to images of respective colors.

Then, the latent electrostatic images are developed by the development devices 13C, 13M, 13Y, and 13K to form toner images. The development devices 13C, 13M, 13Y, and 13K develop the latent electrostatic images with toner of C (cyan), M (magenta), Y (yellow), and K (black), respectively. Respective toner images formed on the four image bearing members 10C, 10M, 10Y, and 10K are overlapped on the transfer belt 19.

A transfer paper 15 is sent out from a tray by a feeding roller 21, temporarily held at a pair of registration rollers 22, and fed to the transfer member 23 in synchronization with image formation on the image bearing members 10C, 10M, 10Y, and 10K. The toner image borne on the transfer belt 19 is transferred to the transfer paper 15 by an electric field formed by the potential difference between the transfer bias applied to the transfer member 23 and the voltage of the transfer belt 19. The toner image transferred to the transfer paper 15 is transferred to a fixing member 24 where the toner is fixed on the transfer paper 15 and then the transfer paper 15 is discharged to the outside. In addition, toner which has remained untransferred on the image bearing embers 10C, 10M, 10Y, and 10K and are collected by the cleaner 17C, 17M, 17Y, and 17K provided in each unit.

As illustrated in FIG. 7, the intermediate transfer system is particularly suitable for an image forming apparatus that can produce full color images. That is, in this system, multiple toner images are temporarily transferred to and overlapped on the intermediate transfer body, which is advantageous in terms of controlling prevention of color misalignment and improvement of the image quality. The intermediate transfer body is made of various kinds of materials and can have various kinds of forms such as a drum form and a belt form. Any known intermediate transfer body can be used in the present disclosure, which is also preferable in terms of improvement of the durability of the image bearing member and the quality of produced images.

In FIG. 7, the image formation elements are arranged in the sequence of C (cyan), M (magenta), Y (yellow), and K (black) from the upstream to the downstream relative to the transfer direction of the transfer paper, but the sequence is not limited thereto. The sequence of the color is arbitrarily determined. In addition, when an image of only black color is output, it is particularly suitable to used a mechanism that suspends the image formation elements 20C, 20M, and 20Y) other than the black color in the present disclosure.

Since the image forming apparatus employing the tandem system described above is able to transfer multiple toner images once, a high speed full color printing is enabled. However, since at least four image bearing members are required, the size of the image forming apparatus inevitably increases. In addition, depending on the amount of toner consumed, the degree of abrasion among the image bearing members varies, which may lead to problems such as degradation of the color reproduction and production of defective images. In the present disclosure, since the image bearing member having a highly durable cross-linked surface layer is used. The image bearing member can have a reduced diameter, a high charge transport function, and reduce the rise of residual voltage and the impact of the deterioration of the sensitivity. Therefore, if the four image bearing members are not evenly used, the variance in the rise of the residual voltage and the deterioration of the sensitivity over repetitive use is small, which leads to production of full color images with excellent color reproducibility for a long period of time.

Such an image forming unit including the image bearing member of the present disclosure is used in the image forming apparatus and the image forming method of the present disclosure. That may be fixed in and incorporated into a photocopier, a facsimile machine, or a printer or may form a process cartridge detachably attachable to such an apparatus.

Process Cartridge

The process cartridge of the present disclosure includes the image bearing member described above and at least one device selected from optional devices such as a charging device, an irradiation device, a development device, a transfer device, a cleaning device and a discharging device, and is detachably attachable to an image forming apparatus.

Figure 5:
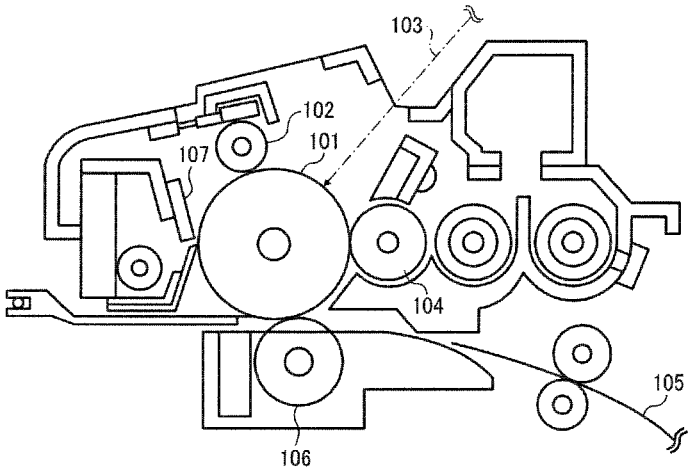
FIG. 5 is a schematic diagram illustrating an example of the process cartridge for use in the image forming apparatus of the present disclosure.

FIG. 5 is a diagram illustrating an example of the process cartridge.

The process cartridge for use in an image forming apparatus is a device (or part) that integrates a photoreceptor (image bearing member) 101 therein, includes at least one device selected from a charger 102, a development device 104, a transfer device 106, a cleaning device 107, and a discharger, and is detachably mounted to the main body of the image forming apparatus. The image forming process by the apparatus illustrated in FIG. 5 is described next. While the photoreceptor 101 rotates in the direction indicated by an arrow in FIG. 5, a latent electrostatic image corresponding to the exposure image is formed on the surface of the photoreceptor 101 through charging and irradiating the surface thereof by the charging device 102 and an irradiation device 103. This latent electrostatic image is developed with toner by the development device 104, and the toner image is transferred to a transferring medium 105 by the transfer device 106. Then, the surface of the photoreceptor 101 is cleaned after the image transfer by the cleaning device 107 and discharged by the discharger to be ready for the next image forming cycle.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

First, synthesis of the charge generating material (titanyl phthalocyanine crystal) is described.

Synthesis of Titanylphthalocyanine Crystal

The method of synthesizing titanyl phthlocyanine crystal for use in the present disclosure is described below. Titanyl phthalocyanine is synthesized by the method according to JP-2004-83859-A. That is, 292 parts of 1,3-diiminoisoindoline and 1,800 parts of sulfolane are mixed and 204 parts of titanium tetrabutoxido is dropped thereto in nitrogen atmosphere. Thereafter, the temperature is gradually raised to 180° C., and the resultant is stirred to conduct reaction for five hours while the reaction temperature is maintained in the range of from 170° C. to 180° C. After the reaction is complete, the resultant is left to be cooled down and the precipitation is filtered. The filtered resultant is washed with chloroform until the color of the obtained powder becomes blue. Next, the resultant powder is washed with methanol several times. Further, the resultant is washed with hot water of 80° C. several times and dried to obtain a coarse titanyl phthalocyanine. The obtained coarse titanyl phthalocyanine is dissolved in strong sulfuric acid the amount of which is 20 times as much as that of the titanyl phthalocyanine. The resultant is dropped to iced water the amount which is 100 times as much as that of the titanyl phthalocyanine. The precipitated crystal is filtrated and repeatedly water-washed with deionized water (pH: 7.0, specific conductivity: 1.0 μS/cm) until the deionized water has a pH of 6.8 and a specific conductivity of 2.6 μS/cm after washing. A wet cake (water paste) of titanyl phthalocyanine pigment is obtained.

40 parts of the thus obtained wet cake (water paste) is put in 200 parts of tetrahydrofuran and vigorously stirred with HOMOMIXER (MARKII f model, manufactured by KENIS, Ltd.) at 2,000 rpm at room temperature until the color of the paste changed from navy blue to light blue (20 minutes after initiation of stirring), immediately followed by filtration with a reduced pressure. The crystals on the filtration device are washed with tetrahydrofuran to produce a wet cake of the pigment. The wet cake is then dried for two days at 70° C. under a reduced pressure of 5 mmHg to produce 8.5 parts of a titanyl phthalocyanine crystal. The solid portion density of the wet cake is 15% by weight. The weight ratio of the solvent for crystal conversion to the wet cake is 33. No halogenated material is used in the raw material for synthesis. The thus-obtained titanylphthalocyanine powder is measured about X ray diffraction spectrum under the following conditions: The results are that the thus obtained titanyl phthalocyanine powder has a CuKα X ray diffraction spectrum having a wavelength of 1.542 Å such that the maximum diffraction peak is observed at a Bragg (2θ) angle of 27.2°±0.2°, the main peaks at a Bragg (2θ) angle of 9.4°±0.2°, 9.6°±0.2°, and 24.0°±0.2°, and a peak at a Bragg (2θ) angle of 7.3°±0.2° as the lowest angle diffraction peak while no peak between the peak at 7.3°±0.2° and the peak at 9.4°±0.2° and no peak at 26.3° are observed.

The results are shown in FIG. 3.

Measuring Conditions of X Ray Diffraction Spectrum

X ray tube: Cu
Voltage: 50 kV
Current: 30 mA
Scanning speed: 2°/min
Scanning range: 3° to 40°
Time constant: 2 seconds Example 1

Liquid application of undercoating layer having the following recipe is applied to an aluminum substrate (outer diameter: 60 mmΦ) by a dip coating method to form an undercoating layer having a thickness of 3.5 μm after drying at 130° C. for 20 minutes.

Liquid Application for Undercoating Layer

| | |
|---|---|
| Titanium dioxide powder (TIPAQUE CR-EL, manufactured by Ishihara Sangyo Kaisha Ltd.): | 400 parts |
| Melamine resin (Super-beckamine G-821-60, manufactured by Dainippon Ink and Chemicals, Inc.): | 65 parts |
| Alkyd resin (Beckolite M6401-50, manufactured by Dainippon Ink and Chemicals, Inc.): | 120 parts |
| 2-butanone: | 400 parts |

Liquid application for charge generating layer having the following recipe is applied to the undercoating layer formed as described above by a dip coating followed by heating and drying at 90° C. for 20 minutes to form a charge generating layer having a thickness of 0.2 μm.

Liquid Application for Charge Generating Layer

| | |
|---|---|
| Titanylphthalocyanine: | 8 parts |
| Polyvinylbutyral (BX-1, manufactured by Sekisui Chemical Co., Ltd.): | 5 parts |
| 2-butanone: | 400 parts |

Liquid application for charge transport layer containing the charge transport material represented by the following chemical formula 1 is applied to the charge generating layer by dip coating followed by heating and drying at 120° C. for 20 minutes to form a charge transport layer having a thickness of 23 μm.

Liquid Application for Charge Transport Layer

| | |
|---|---|
| Z type polycarbonate (TS-2050, manufactured by Teijin Chemicals Ltd.): | 10 parts |
| Charge Transport Material represented by the following Chemical formula 1: | 9 parts |

Chemical formula 1

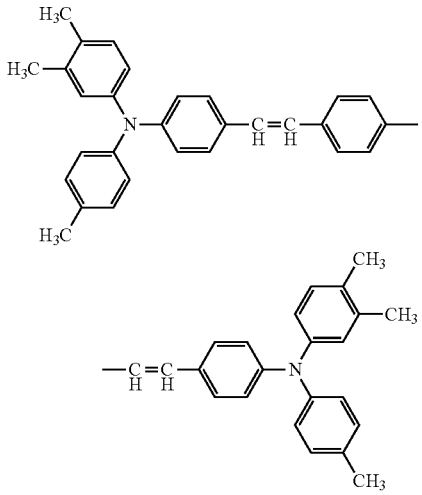

| | |
|---|---|
| Tetrahydrofuran: | 100 parts |

Liquid application for cross-linked surface layer having the following recipe is applied to the charge transport layer by spray coating followed by irradiation by a metal halide lamp with an irradiation intensity of 500 mW/cm2 for 160 seconds, and drying at 130° C. for 30 minutes to obtain a cross-linked surface layer having a thickness of 4.0 μm. A photoreceptor of the present disclosure is thus obtained.

Liquid Application for Cross-Linked Surface Layer

| | |
|---|---|
| Radical polymerizable monomer (trimethylol propane acrylate) (KAYARAD TMPTA, manufactured by Nippon Kayaku Co., Ltd.): | 10 parts |
| Compound No. 2 illustrated above: | 10 parts |
| Photopolymerization initiator (IRGACURE 184, manufactured by Chiba Specialty Chemicals): | 1 part |
| Tetrahydrofuran: | 100 parts |

Example 2

The image bearing member of Example 2 is manufactured in the same manner as in Example 1 except that 10 parts of the compound No. 3 illustrated above is used instead of 10 parts of the compound No. 2.

Example 3

The image bearing member of Example 3 is manufactured in the same manner as in Example 1 except that 10 parts of the compound No. 5 illustrated above is used instead of 10 parts of the compound No. 2.

Example 4

The image bearing member of Example 4 is manufactured in the same manner as in Example 1 except that the recipe of the liquid application for cross-linked surface layer is changed to the following.

Liquid Application for Cross-Linked Surface Layer

| | |
|---|---|
| Radical polymerizable monomer (trimethylol propane triacrylate) (KAYARAD TMPTA, manufactured by Nippon Kayaku Co., Ltd.): | 10 parts |
| Compound No. 2 illustrated above: | 10 parts |
| Photopolymerization initiator (IRGACURE 184, manufactured by Chiba Specialty Chemicals): | 1 part |
| Aluminum particulates (AA02, manufactured by Sumitomo Chemical Co., Ltd.): | 5 parts |
| Tetrahydrofuran: | 100 parts |

Example 5

The image bearing member of Example 5 is manufactured in the same manner as in Example 1 except that the recipe of the liquid application for cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound No. 8 illustrated above: | 10 parts |
| Photopolymerization initiator (IRGACURE 184, manufactured by Chiba Specialty Chemicals): | 1 part |
| Aluminum particulates (AA02, manufactured by Sumitomo Chemical Co., Ltd.): | 5 parts |
| Tetrahydrofuran: | 100 parts |

Example 6

The image bearing member of Example 6 is manufactured in the same manner as in Example 1 except that 10 parts of the compound No. 1 illustrated above is used instead of 10 parts of the compound No. 2 illustrated above.

Example 7

The image bearing member of Example 7 is manufactured in the same manner as in Example 1 except that 10 parts of the compound No. 12 illustrated above is used instead of 10 parts of the compound No. 2 illustrated above.

Example 8

The image bearing member of Example 8 is manufactured in the same manner as in Example 1 except that the recipe of the liquid application for cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound No. 10 illustrated above: | 10 parts |
| Photopolymerization initiator (IRGACURE 184, manufactured by Chiba Specialty Chemicals): | 1 part |
| Aluminum particulates (AA02, manufactured by Sumitomo Chemical Co., Ltd.): | 5 part |
| Tetrahydrofuran: | 100 parts |

Example 9

The image bearing member of Example 9 is manufactured in the same manner as in Example 1 except that the recipe of the liquid application for cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Co., Ltd.): | 10 parts |
| Compound No. 13 illustrated above: | 10 parts |
| Photopolymerization initiator (IRGACURE 184, manufactured by Chiba Specialty Chemicals): | 1 part |
| Aluminum particulates (AA02, manufactured by Sumitomo Chemical Co., Ltd.): | 5 parts |
| Tetrahydrofuran: | 100 parts |

Example 10

The image bearing member of Example 10 is manufactured in the same manner as in Example 1 except that 10 parts of the compound No. 16 illustrated above is used instead of 10 parts of the compound No. 2 illustrated above.

Example 11

The image bearing member of Example 11 is manufactured in the same manner as in Example 1 except that 10 parts of the compound No. 17 illustrated above is used instead of 10 parts of the compound No. 2 illustrated above.

Comparative Example 1

The image bearing member of Comparative Example 1 is manufactured in the same manner as in Example 1 except that the recipe of the liquid application for cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound having the following chemical formula 2: | 10 parts |

Chemical formula 2

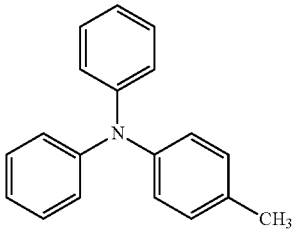

| | |
|---|---|
| Photopolymerization initiator (IRGACURE 184, manufactured by Chiba Specialty Chemicals): | 1 part |
| Tetrahydrofuran: | 100 parts |

Comparative Example 2

The image bearing member of Comparative Example 2 is manufactured in the same manner as in Example 1 except that the recipe of the liquid application for cross-linked surface layer is changed to the following.

Liquid Application for Cross-Linked Surface Layer

| | |
|---|---|
| Radical polymerizable monomer (trimethylol propane acrylate) KAYARAD TMPTA, manufactured by Nippon Kayaku Corporation): | 10 parts |
| Compound having the following Chemical formula 3: | 10 parts |

Chemical formula 3

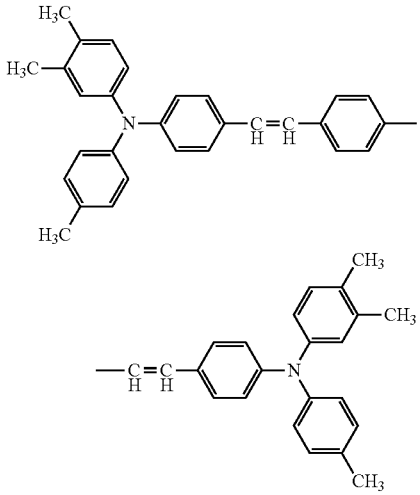

| | |
|---|---|
| Photopolymerization initiator (IRGACURE 184, manufactured by Chiba Specialty Chemicals): | 1 part |
| Tetrahydrofuran: | 100 parts |

Comparative Example 3

The image bearing member of Comparative Example 3 is manufactured in the same manner as in Example 1 except that the recipe of the cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Co., Ltd.): | 10 parts |
| Compound having the following Chemical formula 4: | 10 parts |

Chemical formula 4

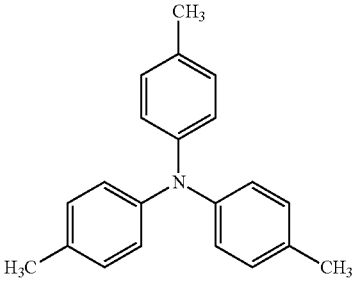

| | |
|---|---|
| Photopolymerization initiator (IRGACURE 184, manufactured by Chiba Specialty Chemicals): | 1 part |
| Aluminum particulates (AA02, manufactured by Sumitomo Chemical Co., Ltd.) | 5 parts |
| Tetrahydrofuran: | 100 parts |

Comparative Example 4

The image bearing member of Comparative Example 4 is manufactured in the same manner as in Example 1 except that the recipe of the liquid application for cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound having the following chemical formula 5: | 10 parts |

Chemical formula 5

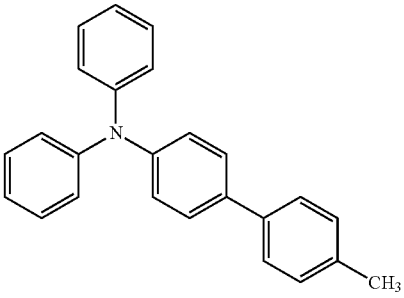

| | |
|---|---|
| Photopolymerization initiator (IRGACURE 184, manufactured by Chiba Specialty Chemicals): | 1 part |
| Aluminum particulates (AA02, manufactured by Sumitomo Chemical Co., Ltd.) | 5 parts |
| Tetrahydrofuran: | 100 parts |

Comparative Example 5

The image bearing member of Comparative Example 5 is manufactured in the same manner as in Example 1 except that the recipe of the cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Co., Ltd.): | 10 parts |
| Compound having the following chemical formula 6: | 10 parts |

Chemical formula 6

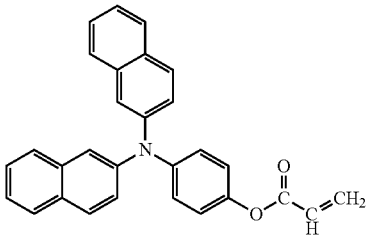

| | |
|---|---|
| Photopolymerization initiator (IRGACURE 184, manufactured by Chiba Specialty Chemicals): | 1 part |
| Tetrahydrofuran: | 100 parts |

Comparative Example 6

The image bearing member of Comparative Example 6 is manufactured in the same manner as in Example 1 except that the recipe of the liquid application for cross-linked surface layer is changed to the following.

Liquid Application for Cross-Linked Surface Layer

| | |
|---|---|
| Radical polymerizable monomer (trimethylol propane triacrylate) (KAYARAD TMPTA, manufactured by Nippon Kayaku Co., Ltd.): | 10 parts |
| Compound having the following chemical formula 7: | 10 parts |

Chemical formula 7

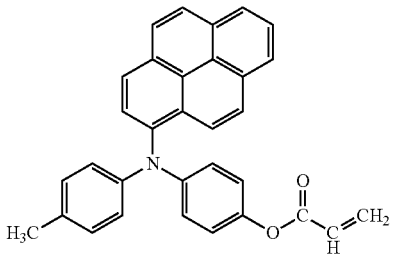

| | |
|---|---|
| Photopolymerization initiator (IRGACURE 184, manufactured by Chiba Specialty Chemicals): | 1 part |
| Aluminum particulates (AA02, manufactured by Sumitomo Chemical Co., Ltd.) | 5 parts |
| Tetrahydrofuran: | 100 parts |

Evaluation

The image bearing members manufactured in Examples and Comparative Examples are evaluated.

A process cartridge in which one of the image bearing members of Examples and Comparative Examples are installed is mounted on a full color digital photocopier having a tandem system (imagio MPC7500, manufactured by Ricoh Co., Ltd.). Images (evenly arranged texts occupying 5% of the sheet as the imaging area) are printed on 200,000 sheets in total. The voltage at irradiated portion (VL), variance in one job, image quality, and abrasion amount are evaluated at initial printing and after printing.

The variance in job is measured by a surface electrometer in such a manner that the voltage at irradiated portion (VL) of the image bearing member is measured initially and after a job of continuous image printing on 50 sheets is repeated ten times. (VL after repeating the job ten times)−(initial VL) is evaluated as the variation in job.

In addition to the measuring values, the determination results about whether the values are correctable in terms of usage in the process are also shown.

Criteria on Variation in Job

E (Excellent): No problem

G (Good): Slightly varied but correctable, causing no actual problem

F (Fair): Significantly varied, slightly beyond the tolerance level

B (Bad): Greatly varied, causing problem

The decreasing amount of the thickness of the image bearing member caused by abrasion from the initial state is obtained by measuring the thickness of the image bearing member at 20 points thereon by an eddy current thickness tester (Fisher scope MMS).

The evaluation results are shown in Table 1.

TABLE 1

| | Initial | | | |
|---|---|---|---|---|
| | VL (−V) | Variation in job | | Image quality |
| Example 1 | 94 | 12 | E | Good |
| Example 2 | 102 | 14 | E | Good |
| Example 3 | 106 | 15 | E | Good |
| Example 4 | 95 | 13 | E | Good |
| Example 5 | 103 | 18 | E | Good |
| Example 6 | 109 | 12 | E | Good |
| Example 7 | 112 | 10 | E | Good |
| Example 8 | 115 | 12 | E | Good |
| Example 9 | 113 | 12 | E | Good |
| Example 10 | 105 | 14 | E | Good |
| Example 11 | 99 | 13 | E | Good |
| Comparative Example 1 | 132 | 25 | G | Good |
| Comparative Example 2 | 162 | 28 | G | Good |
| Comparative Example 3 | 136 | 25 | G | Good |
| Comparative Example 4 | 130 | 21 | G | Good |
| Comparative Example 5 | 145 | 21 | G | Good |
| Comparative Example 6 | 138 | 26 | G | Good |

| | After 200,00 sheets | | | | |
|---|---|---|---|---|---|
| | VL (−V) | Variation in job | | Image quality | Abrasion amount |
| Example 1 | 110 | 16 | E | Good | 1.5 |
| Example 2 | 115 | 22 | G | Good | 1.4 |
| Example 3 | 110 | 25 | G | Good | 1.4 |
| Example 4 | 114 | 18 | E | Good | 0.2 |
| Example 5 | 109 | 26 | G | Good | 0.3 |
| Example 6 | 111 | 13 | E | Good | 1.5 |
| Example 7 | 115 | 14 | E | Good | 1.4 |
| Example 8 | 120 | 15 | E | Good | 0.3 |
| Example 9 | 113 | 15 | E | Good | 0.3 |
| Example 10 | 120 | 26 | G | Good | 1.5 |
| Example 11 | 118 | 24 | G | Good | 1.6 |
| Comparative Example 1 | 152 | 45 | B | Image blue | 1.6 |
| Comparative Example 2 | 230 | 68 | B | Image blue Image density thinned | 1.7 |
| Comparative Example 3 | 174 | 51 | B | Image blue | 0.3 |

TABLE 1-continued

| | | | | | |
|---|---|---|---|---|---|
| Comparative Example 4 | 166 | 43 | B | Image blue | 0.3 |
| Comparative Example 5 | 150 | 37 | F | Good | 1.3 |
| Comparative Example 6 | 148 | 39 | F | Good | 0.2 |

As seen in the evaluation results, the image bearing members of Examples 1 to 15 are stable about their characteristics after the 200,000 printing, the rise of the voltage at irradiated portions (VL) and the variance in job are reduced and the image quality is good.

To the contrary, with regard to the image bearing members of Comparative Examples 1 to 4, the image quality deteriorates about image blur, etc. and the variance in job increases after the 200,000 printing.

The image bearing members of Comparative Examples 5 and 6 maintains the quality of images after the 200,000 printing, but deteriorates with regard to variation in job, thereby changing the image density and the color when the same image is continuously output.

Example 12

Liquid application having the following recipe is applied to an aluminum substrate (outer diameter: 30 mmΦ) by a dip coating method followed by drying to form an undercoating layer having a thickness of 3.5 μm.

Liquid Application for Undercoating Layer

| | |
|---|---|
| Alkyd resin (Beckozole 1307-60-EL, manufactured by Dainippon Ink and Chemicals, Inc.): | 6 parts |
| Melamine resin (Super-beckamine G-821-60, manufactured by Dainippon Ink and Chemicals, Inc.): | 4 parts |
| Titanium oxide (CR-EL, manufactured by Ishihara Sangyo Kaisha, Ltd.): | 40 parts |
| Methylethylketone: | 50 parts |

Liquid application for charge generating layer containing the bisazo pigment represented by the following chemical formula 8 is applied to the undercoating layer by dip coating followed by heating and drying to form a charge generating layer having a thickness of 0.2 μm.

Liquid Application for Charge Generating Layer

| | |
|---|---|
| Bisazo pigment represented by the following chemical structure: | 2.5 parts |

Chemical formula 8

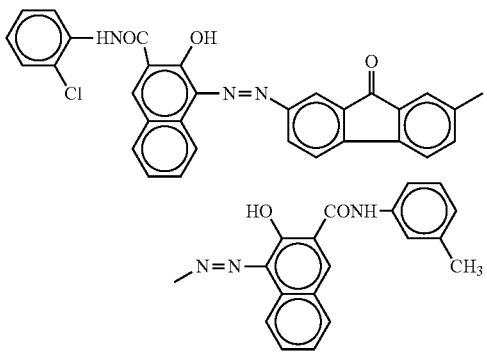

| | |
|---|---|
| Polyvinyl butyral {XYHL, manufactured by Union Carbide Corporation (UCC): | 0.5 parts |
| Cyclohexanone: | 200 parts |
| Methylethylketone: | 80 parts |

Liquid application for charge transport layer containing the following recipe is applied to the charge generation layer by dip coating followed by heating and drying to form a charge transport layer having a layer thickness of 22 μm.

Liquid Application for Charge Transport Layer

| | |
|---|---|
| Bisphenol Z type polycarbonate: | 10 parts |
| Charge transport material having a small molecular weight represented by the following chemical formula 9: | 10 parts |

Chemical formula 9

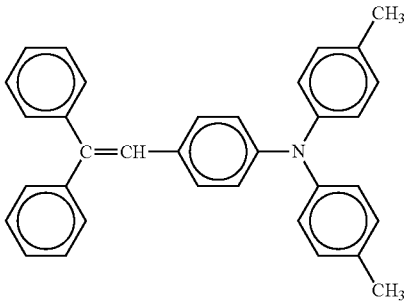

| | |
|---|---|
| Tetrahydrofuran: | 80 parts |
| Tetrahydrofuran solution of 1% Silicon oil (KF50-100CS, manufactured by Shin-Etsu Chemical Co., Ltd.): | 0.2 parts |

Liquid application for cross-linked surface layer having the following recipe is applied to the charge transport layer by spray coating followed by irradiation by a metal halide lamp with an irradiation intensity of 500 mW/cm2 for 160 seconds, and drying at 130° C. for 30 minutes to obtain a cross-linked surface layer having a thickness of 4.0 μm. A photoreceptor of the present disclosure is thus obtained.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound having the following chemical formula 10 (absorption at 350 nm): | 10 parts |

Chemical formula 10

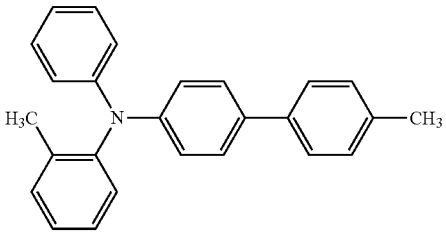

| | |
|---|---|
| Photopolimerization initiator (IRGACURE 2959, manufactured by Chiba Specialty Chemicals): | 1 part |
| Tetrahydrofuran: | 100 parts |

Example 13

The image bearing member of Example 13 is manufactured in the same manner as in Example 12 except that the recipe of liquid application for the cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound having the following chemical formula 11 (no absorption at 350 nm or higher): | 10 parts |
| Photopolimerization initiator (IRGACURE 184, manufactured by Chiba Specialty Chemicals): | 1 part |
| Tetrahydrofuran: | 100 parts |

Chemical formula 11

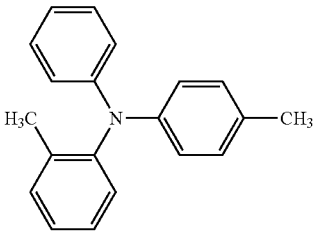

Example 14

The image bearing member of Example 14 is manufactured in the same manner as in Example 12 except that the recipe of the liquid application for cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound having the following chemical formula 12 (no absorption at 350 nm or higher): | 10 parts |
| Photopolimerization initiator (IRGACURE 907, manufactured by Chiba Specialty Chemicals): | 1 part |
| Aluminum particulates (AA02, manufactured by Sumitomo Chemical Co., Ltd.): | 5 parts |
| Tetrahydrofuran: | 100 parts |

Chemical formula 12

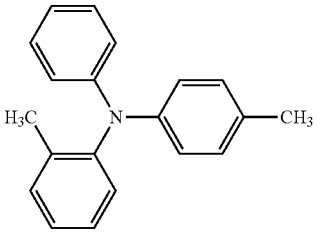

Example 15

The image bearing member of Example 15 is manufactured in the same manner as in Example 12 except that the recipe of the liquid application for cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |

-continued

| | |
|---|---|
| Compound having the following chemical formula 13 (no absorption at 350 nm or higher): | 10 parts |
| Photopolimerization initiator (IRGACURE 184, manufactured by Chiba Specialty Chemicals): | 1 part |
| Aluminum particulates (AA02, manufactured by Sumitomo Chemical Co., Ltd.) | 5 parts |
| Tetrahydrofuran: | 100 parts |

Chemical formula 13

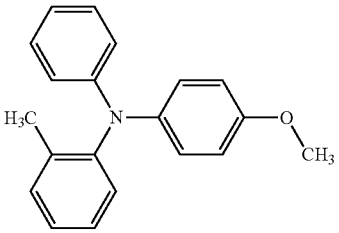

Example 16

The image bearing member of Example 16 is manufactured in the same manner as in Example 12 except that the recipe of the liquid application for cross-linked surface layer is changed to the following.

Liquid Application for Cross-Linked Surface Layer

| | |
|---|---|
| Radical polymerizable monomer (trimethylol propane triacrylate) (KAYARAD TMPTA, manufactured by Nippon Kayaku Corporation): | 10 parts |
| Compound having the following chemical formula 14 (no absorption at 350 nm or higher): | 10 parts |
| Photopolimerization initiator (IRGACURE 369, manufactured by Chiba Specialty Chemicals): | 1 part |
| Tetrahydrofuran: | 100 parts |

Chemical formula 14

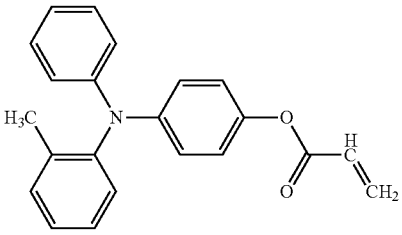

Example 17

The image bearing member of Comparative Example 14 is manufactured in the same manner as in Example 12 except that the recipe of the liquid application for cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound having the following chemical formula 15 (absorption at 350 nm or higher): | 10 parts |

Chemical formula 15

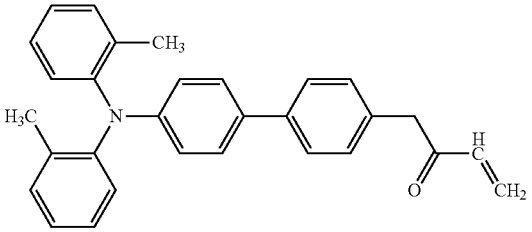

| | |
|---|---|
| Photopolimerization initiator (IRGACURE 184, manufactured by Chiba Specialty Chemicals): | 1 part |
| Aluminum particulates (AA02, manufactured by Sumitomo Chemical Co., Ltd.): | 5 parts |
| Tetrahydrofuran: | 100 parts |

Example 18

The image bearing member of Example 18 is manufactured in the same manner as in Example 12 except that the recipe of the liquid application for cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound having the following chemical formula 14 (no absorption at 350 nm or higher): | 10 parts |

Chemical formula 16

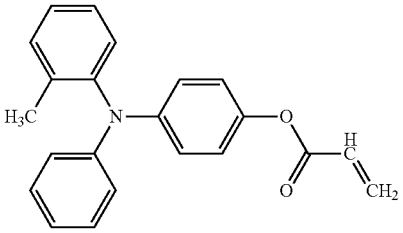

| | |
|---|---|
| Photopolimerization initiator (IRGACURE 184, manufactured by Chiba Specialty Chemicals): | 1 part |
| Aluminum particulates (AA02, manufactured by Sumitomo Chemical Co., Ltd.): | 5 parts |
| Tetrahydrofuran: | 100 parts |

Comparative Example 7

The image bearing member of Comparative Example 7 is manufactured in the same manner as in Example 12 except that the recipe of the cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |

-continued

| | |
|---|---|
| Compound having the following chemical formula 17 (absorption at 350 nm): | 10 parts |

Chemical formula 17

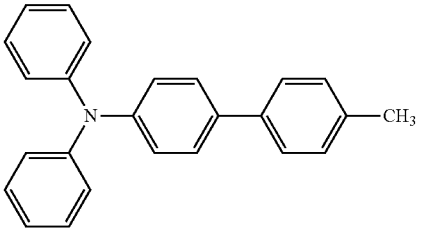

| | |
|---|---|
| Photopolimerization initiator (IRGACURE 2959, manufactured by Chiba Specialty Chemicals): | 1 part |
| Tetrahydrofuran: | 100 parts |

Comparative Example 8

The image bearing member of Comparative Example 8 is manufactured in the same manner as in Example 12 except that the recipe of the cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound having the following chemical formula 18 (no absorption at 350 nm or higher): | 10 parts |

Chemical formula 18

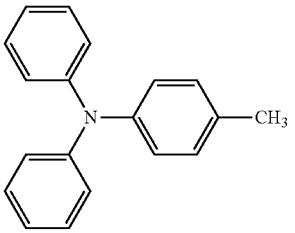

-continued

| | |
|---|---|
| Photopolimerization initiator (IRGACURE 184, manufactured by Chiba Specialty Chemicals): | 1 part |
| Tetrahydrofuran: | 100 parts |

Comparative Example 9

The image bearing member of Comparative Example 9 is manufactured in the same manner as in Example 12 except that the recipe of the liquid application for cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound having the following chemical formula 19 (no absorption at 350 nm or higher): | 10 parts |

Chemical formula 19

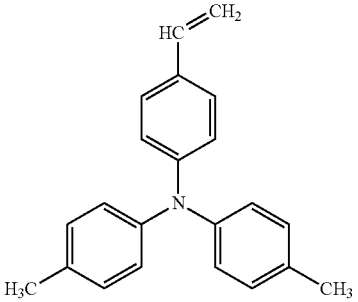

| | |
|---|---|
| Photopolimerization initiator (IRGACURE 184, manufactured by Chiba Specialty Chemicals): | 1 part |
| Tetrahydrofuran: | 100 parts |

Comparative Example 10

The image bearing member of Comparative Example 14 is manufactured in the same manner as in Example 12 except that the recipe of the liquid application for cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound having the following chemical formula 20 (no absorption at 350 nm or longer): | 10 parts |

Chemical formula 20

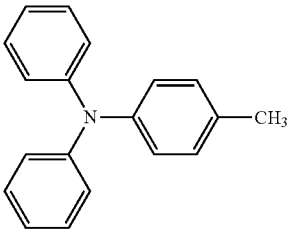

| | |
|---|---|
| Photopolimerization initiator (IRGACURE 907, manufactured by Chiba Specialty Chemicals): | 1 part |

-continued

| | |
|---|---|
| Aluminum particulates (AA02, manufactured by Sumitomo Chemical Co., Ltd.): | 5 parts |
| Tetrahydrofuran: | 100 parts |

Comparative Example 11

The image bearing member of Comparative Example 11 is manufactured in the same manner as in Example 12 except that the recipe of the liquid application for cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound having the following chemical formula 21 (no absorption at 350 nm or higher): | 10 parts |

Chemical formula 21

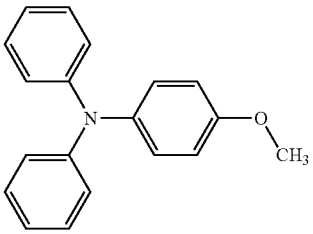

| | |
|---|---|
| Photopolimerization initiator (IRGACURE 184, manufactured by Chiba Specialty Chemicals): | 1 part |
| Aluminum particulates (AA02, manufactured by Sumitomo Chemical Co., Ltd.): | 5 parts |
| Tetrahydrofuran: | 100 parts |

Comparative Example 12

The image bearing member of Comparative Example 12 is manufactured in the same manner as in Example 12 except that the recipe of the cross-linked surface layer is changed to the following.

Liquid Application for Cross-Linked Surface Layer

| | |
|---|---|
| Radical polymerizable monomer (trimethylol propane triacrylate) (KAYARAD TMPTA, manufactured by Nippon Kayaku Corporation): | 10 parts |
| Compound having the following chemical formula 22 (no absorption at 350 nm or higher): | 10 parts |

Chemical formula 22

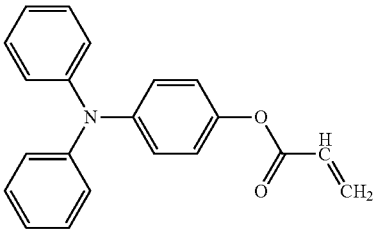

| | |
|---|---|
| Photopolimerization initiator (IRGACURE 369, manufactured by Chiba Specialty Chemicals): | 1 part |
| Tetrahydrofuran: | 100 parts |

Comparative Example 13

The image bearing member of Comparative Example 13 is manufactured in the same manner as in Example 12 except that the recipe of the liquid application for cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound having the following chemical formula 23 (absorption at 350 nm or higher): | 10 parts |

Chemical formula 23

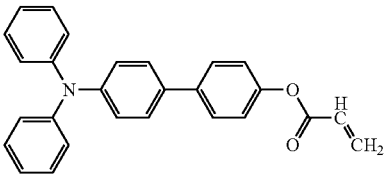

| | |
|---|---|
| Photopolimerization initiator (IRGACURE 184, manufactured by Chiba Specialty Chemicals): | 1 part |
| Aluminum particulates (AA02, manufactured by Sumitomo Chemical Co., Ltd.): | 5 parts |
| Tetrahydrofuran: | 100 parts |

Comparative Example 14

The image bearing member of Comparative Example 14 is manufactured in the same manner as in Example 12 except that the recipe of the liquid application for cross-linked surface layer is changed to the following.

Liquid Application for Cross-Linked Surface Layer

| | |
|---|---|
| Radical polymerizable monomer (trimethylol propane acrylate) (KAYARAD TMPTA, manufactured by Nippon Kayaku Corporation): | 10 parts |
| Compound having the following chemical formula 24 (no absorption at 350 nm or higher): | 10 parts |

Chemical formula 24

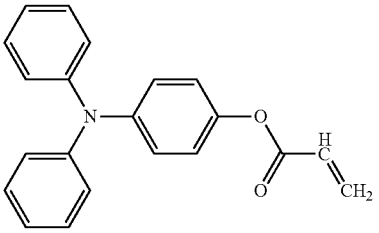

| | |
|---|---|
| Photopolimerization initiator (IRGACURE 184, manufactured by Chiba Specialty Chemicals): | 1 part |
| Aluminum particulates (AA02, manufactured by Sumitomo Chemical Co., Ltd.): | 5 parts |
| Tetrahydrofuran: | 100 parts |

Comparative Example 15

The image bearing member of Comparative Example 15 is manufactured in the same manner as in Example 12 except that no cross-linked surface layer is provided and the thickness of the charge transport layer is changed to 28 μm.

Evaluation of Image Bearing Members of Examples and Comparative Examples.

Actual Machine Test

Using the manufactured image bearing members and an image forming apparatus (Ipsio Color CX9000, manufactured by Ricoh Co., Ltd.), an actual machine test is performed with a run length of 2000,000 sheets (A4, MyPaper, manufactured by NBS Ricoh Co., Ltd.) to evaluate the abrasion resistance, the voltage in the machine, and the image quality. The results are shown in Tables 2, 3, and 4.

The decreasing amount of the thickness of the image bearing member caused by abrasion from the initial state is obtained by measuring the thickness of the image bearing member at 20 points thereon by an eddy current thickness tester (Fisher scope MMS).

TABLE 2

| | Abrasion amount (μm) | | | |
|---|---|---|---|---|
| | 50,000 sheets | 100,000 sheets | 150,000 sheets | 200,000 sheets |
| Example 12 | 0.56 | 1.13 | 1.65 | 2.22 |
| Example 13 | 0.49 | 1.01 | 1.34 | 1.98 |
| Example 14 | 0.34 | 0.70 | 0.93 | 1.31 |
| Example 15 | 0.36 | 0.73 | 1.06 | 1.43 |
| Example 16 | 0.38 | 0.78 | 1.14 | 1.53 |
| Example 17 | 0.35 | 0.74 | 1.05 | 1.42 |
| Example 18 | 0.25 | 0.51 | 0.75 | 1.01 |
| Comparative Example 7 | 0.58 | 1.15 | 1.64 | 2.25 |
| Comparative Example 8 | 0.51 | 1.01 | 1.44 | 1.98 |
| Comparative Example 9 | 0.43 | 0.87 | 1.33 | 1.75 |
| Comparative Example 10 | 0.35 | 0.74 | 1.05 | 1.42 |
| Comparative Example 11 | 0.36 | 0.76 | 1.11 | 1.49 |
| Comparative Example 12 | 0.37 | 0.76 | 1.15 | 1.52 |
| Comparative Example 13 | 0.34 | 0.69 | 1.02 | 1.37 |
| Comparative Example 14 | 0.27 | 0.55 | 0.76 | 1.05 |
| Comparative Example 15 | 4.82 | 10.60 | — | — |

With regard to the image bearing member of Comparative Example 15, since it is extremely abraded, the test is finished with a run length of 100,000.

TABLE 3

| | Voltage in the apparatus (−V) | | | | | |
|---|---|---|---|---|---|---|
| | Initial | | 50,000 sheets | | 100,000 sheets | |
| | VD | VL | VD | VL | VD | VL |
| Example 12 | 700 | 75 | 695 | 80 | 690 | 80 |
| Example 13 | 700 | 75 | 700 | 80 | 695 | 85 |
| Example 14 | 700 | 85 | 700 | 90 | 690 | 85 |
| Example 15 | 700 | 90 | 705 | 95 | 700 | 95 |
| Example 16 | 700 | 85 | 690 | 90 | 685 | 95 |
| Example 17 | 700 | 80 | 705 | 85 | 695 | 85 |
| Example 18 | 700 | 95 | 700 | 100 | 700 | 100 |
| Comparative Example 7 | 700 | 80 | 685 | 95 | 670 | 95 |
| Comparative Example 8 | 700 | 80 | 690 | 100 | 675 | 95 |
| Comparative Example 9 | 700 | 85 | 695 | 100 | 690 | 110 |
| Comparative Example 10 | 700 | 85 | 695 | 105 | 685 | 105 |

TABLE 3-continued

| | Voltage in the apparatus (−V) | | | | | |
|---|---|---|---|---|---|---|
| | Initial | | 50,000 sheets | | 100,000 sheets | |
| | VD | VL | VD | VL | VD | VL |
| Comparative Example 11 | 700 | 85 | 700 | 100 | 695 | 100 |
| Comparative Example 12 | 700 | 80 | 690 | 100 | 685 | 105 |
| Comparative Example 13 | 700 | 90 | 695 | 110 | 685 | 115 |
| Comparative Example 14 | 700 | 95 | 685 | 125 | 680 | 125 |
| Comparative Example 15 | 700 | 55 | 705 | 55 | 720 | 60 |

TABLE 4

| | | 100,000 sheets | | 200,000 sheets | |
|---|---|---|---|---|---|
| | Initial Dot reproducibility | Dot reproducibility | Image density decrease | Dot reproducibility | Image density decrease |
| Example 12 | G | G | G | G | G |
| Example 13 | G | G | G | G | G |
| Example 14 | G | G | G | G | G |
| Example 15 | G | G | G | G | G |
| Example 16 | G | G | G | G | G |
| Example 17 | G | G | G | F | G |
| Example 18 | G | F | G | F | G |
| Comparative Example 7 | G | G | G | F | B |
| Comparative Example 8 | G | G | G | F | B |
| Comparative Example 9 | G | F | F | F | B |
| Comparative Example 10 | G | F | F | F | B |
| Comparative Example 11 | G | G | F | F | B |
| Comparative Example 12 | G | F | F | F | B |
| Comparative Example 13 | G | F | B | B | B |
| Comparative Example 14 | G | F | B | B | B |
| Comparative Example 15 | G | G | G | — | — |

* Dot reproducibility
Dot images are output and evaluated with naked eyes.
G (Good): Good
F (Fair): Dot dust slightly observed
B (Bad): Dot dust observed
Density Decrease
G (Good): Good
F (Fair): Density Slightly thinned
B (Bad): Density Clearly thinned.

In the present invention, by the image bearing member having a mechanically durable cross-linked surface layer which contains the compound represented by the Chemical structure I, modification of the charge transport material upon irradiation of light energy and electron beams is reduced, thereby preventing degradation of the charge transport power. Therefore, since the electrostatic characteristics are stable for repetitive use of the image bearing member for an extended period of time, rises in the voltage at irradiation portions and the residual voltage are reduced.

Furthermore, variation in job is reduced, resulting in stable production of quality images over a long period of time.

In addition, by using the image bearing member described above, an image forming method, an image forming apparatus, and a process cartridge having an image consistency (i.e., image density or colors are less changed) are provided.

Furthermore, by introducing a substitution group to at least one of the phenyl groups in the triphenyl amine structure represented by the Chemical structure II at the ortho position to the nitrogen atom, structural change of the compound having the triphenyl amine structure upon irradiation of light energy can be prevented and a highly durable cross-linked surface layer is formed without inhibiting the development of a three-dimensional network structure of the cross-linked resin.

In addition, since one or two phenyl groups connected to the nitrogen atom has a substitution group at one ortho position, the phenyl groups in the adjacent compounds having the triphenyl structure are easily brought into contact with each other. Therefore, a high charge transport power is obtained so that rises in the residual voltage and deterioration of the chargeability are prevented. Also, since one of the remaining of the phenyl groups has a polymerizable functional group, the compound can be taken in the three-dimensional network structure, thereby improving the mechanical strength.

What is claimed is:

1. An image bearing member comprising:

an electroconductive substrate;

a photosensitive layer overlying the electroconductive substrate; and a cross-linked surface layer overlying the photosensitive layer and comprising a cross-linked polymer and a first compound represented by Chemical structure I or a second compound represented by Chemical structure II;

Chemical structure I

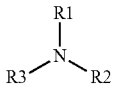

Chemical structure II

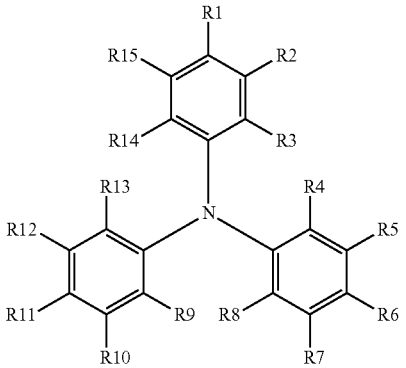

where in Chemical structure I, R1 to R3 independently represent phenyl groups, biphenyl groups, and condensed polycyclic hydrocarbon groups, all of which have no substitution group or a substitution group selected from the group consisting of a non-substituted alkyl group having one to four carbon atoms, a non-substituted alkoxy group having one to four carbon atoms, and a halogen atom, and at least one of R1 to R3 is the condensed polycyclic hydrocarbon group; and in Chemical structure II, R3, R4, R8, R9, R13, and R14 independently represent hydrogen atoms, halogen atoms, alkyl groups, alkoxy groups, or aryl groups excluding a case in which all are hydrogen atoms, and R1, R2, R5, R6, R7, R10, R11, R12 and R15 independently represent hydrogen atoms, halogen atoms, substituted or non-substituted alkyl groups, substituted or non-substituted alkoxy groups, substituted or non-substituted aralkyl groups, substituted or non-substituted aryl groups, substituted or non-substituted alkylene groups, cyano groups, nitro groups, or —O—CO—C═$CH_2$R16, in which R16 represents a hydrogen atom, a substituted or non-substituted alkyl group, a substituted or non-substituted alkoxy group, or a substituted or non-substituted aryl group, wherein a phenyl group having a substitution group at an ortho position has no other substitution group.

2. The image bearing member according to claim 1, wherein the cross-linked surface layer is a cross-linked film cured by irradiation with light.

3. The image bearing member according to claim 2, wherein the cross-linked polymer is formed by curing a radical polymerizable monomer having at least three functional groups and a photopolymerizable initiator by irradiation with light or electron beams.

4. The image bearing member according to claim 1, wherein the cross-linked surface layer comprises inorganic particulates.

5. The image bearing member according to claim 1, wherein the cross-linked surface layer has the second compound in an amount of 10% by weight to 70% by weight.

6. The image bearing member according to claim 1, wherein the second compound has no absorption at a wavelength of 350 nm or longer.

7. The image bearing member according to claim 1, wherein the second compound and the cross-linked polymer are chemically bonded.

8. An image forming method comprising:

charging the image bearing member of claim 1;

irradiating a surface of the image bearing member to form a latent electrostatic image thereon;

developing the latent electrostatic image with a developing agent comprising toner to obtain a visible image; and transferring the visible image to a transfer medium.

9. An image forming apparatus comprising:

the image bearing member of claim 1;

a charging device to charge the image bearing member;

an irradiation device to irradiate a surface of the image bearing member to form a latent electrostatic image thereon;

a development device to develop the latent electrostatic image with a developing agent comprising toner to obtain a visible image; and a transfer device to transfer the visible image to a transfer medium.

10. A process cartridge detachably attachable to an image forming apparatus, comprising:

the image bearing member of claim 1; and one or more devices selected from the group consisting of a charging device to charge the image bearing member, a development device to develop a latent electrostatic image on a surface of the image bearing member with a developing agent comprising toner to obtain a visible image, a transfer device to transfer the visible image to a transfer medium, a cleaning device to remove residual toner remaining on the surface of the image bearing member, and a neutralizing device to remove the charge from the image bearing member.

11. The image bearing member according to claim 1, wherein the cross-linked surface layer comprises a second compound represented by Chemical structure II, with a first phenyl group having a substitution group at an ortho position and a second phenyl group having a functional group reactive with a binder resin.

12. The image bearing member according to claim 11, wherein the functional group reactive with a binder resin is an acryloyloxy or methacryloyloxy group.

13. An image bearing member comprising:

an electroconductive substrate;

a photosensitive layer overlying the electroconductive substrate; and a cross-linked surface layer overlying the photosensitive layer and comprising a cross-linked polymer and a compound represented by Chemical structure I;

Chemical structure I

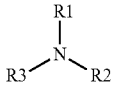

where R1 to R3 independently represent phenyl groups, biphenyl groups, and condensed polycyclic hydrocarbon groups, all of which have no substitution group or a substitution group selected from the group consisting of a non-substituted alkyl group having one to four carbon atoms, a non-substituted alkoxy group having one to four carbon atoms, and a halogen atom, and at least one of R1 to R3 is the condensed polycyclic hydrocarbon group.

14. An image bearing member comprising:

an electroconductive substrate;

a photosensitive layer overlying the electroconductive substrate; and a cross-linked surface layer overlying the photosensitive layer and comprising a cross-linked polymer and a compound represented by Chemical structure II;

Chemical structure II

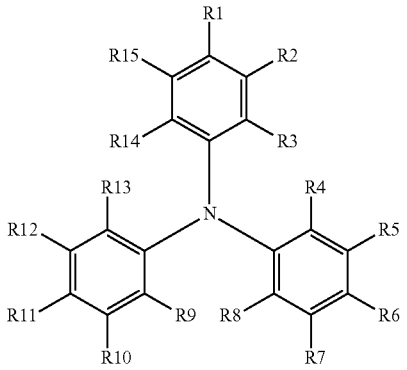

where R3, R4, R8, R9, R13, and R14 independently represent hydrogen atoms, halogen atoms, alkyl groups, alkoxy groups, or aryl groups excluding a case in which all are hydrogen atoms, and R1, R2, R5, R6, R7, R10, R11, R12 and R15 independently represent hydrogen atoms, halogen atoms, substituted or non-substituted alkyl groups, substituted or non-substituted alkoxy groups, substituted or non-substituted aralkyl groups, substituted or non-substituted aryl groups, substituted or non-substituted alkylene groups, cyano groups, nitro groups, or —O—CO—C═$CH_2$R16, in which R16 represents a hydrogen atom, a substituted or non-substituted alkyl group, a substituted or non-substituted alkoxy group, or a substituted or non-substituted aryl group, wherein a phenyl group having a substitution group at an ortho position has no other substitution group.

* * * * *